US011927075B2

(12) United States Patent
Montero et al.

(10) Patent No.: US 11,927,075 B2
(45) Date of Patent: Mar. 12, 2024

(54) BOTTOMHOLE ASSEMBLY

(71) Applicant: NCS MULTISTAGE INC., Calgary (CA)

(72) Inventors: Juan Montero, Calgary (CA); Rio Whyte, Calgary (CA); Brock Gillis, Calgary (CA); Timothy Johnson, Calgary (CA)

(73) Assignee: NCS MULTISTAGE INC., Calgary (CA)

( * ) Notice: Subject to any disclaimer, the term of this patent is extended or adjusted under 35 U.S.C. 154(b) by 205 days.

(21) Appl. No.: 17/438,367

(22) PCT Filed: Jan. 24, 2020

(86) PCT No.: PCT/CA2020/050088
§ 371 (c)(1),
(2) Date: Sep. 10, 2021

(87) PCT Pub. No.: WO2020/181359
PCT Pub. Date: Sep. 17, 2020

(65) Prior Publication Data

US 2022/0145725 A1 May 12, 2022

Related U.S. Application Data

(60) Provisional application No. 62/817,851, filed on Mar. 13, 2019.

(51) Int. Cl.
*E21B 34/14* (2006.01)
*E21B 23/04* (2006.01)

(52) U.S. Cl.
CPC ..... *E21B 34/14* (2013.01); *E21B 23/04* (2013.01); *E21B 2200/06* (2020.05)

(58) Field of Classification Search
CPC ..... E21B 34/08; E21B 34/12; E21B 34/14; E21B 23/04
See application file for complete search history.

(56) References Cited

U.S. PATENT DOCUMENTS 7,077,212 B2 * 7/2006 Roesner ..... E21B 23/06 166/134
2004/0055755 A1 3/2004 Roesner et al.
(Continued)

FOREIGN PATENT DOCUMENTS

WO 2014/044630 A2 3/2014

OTHER PUBLICATIONS

Boulet, Jean-Francois, International Search Report and Written Opinion of the International Searching Authority, Canadian Intellectual Property Office, PCT/CA2020/050088, dated Apr. 22, 2020.

*Primary Examiner* — Cathleen R Hutchins
(74) *Attorney, Agent, or Firm* — Gavrilovich, Dodd & Lindsey LLP

(57) ABSTRACT

There is provided a bottomhole assembly that is deployable downhole within a wellbore via a conveyance system. The conveyance system includes a fluid conductor for effecting fluid communication between the surface and the bottomhole assembly. The bottomhole assembly includes an actuator tool and a shifting tool. In some embodiments, for example, the actuator tool is disposed for receiving transmission of a compressive force being applied to the conveyance system from the surface, and transmitting the compressive force for actuating the shifting tool. In some embodiments, for example, the actuator includes an anchoring tool configured for hydraulic actuation, via fluid pressure forces communicated by the fluid conductor of the conveyance system, for becoming retained relative to the wellbore string. In some embodiments, for example, the actuator tool also includes a linear actuator that is extendible relative to
(Continued)

the anchoring tool, while the anchoring tool is retained relative to the wellbore string, for transmitting a force to the actuated shifting tool with effect that the shifting tool is displaced relative to the wellbore.

17 Claims, 15 Drawing Sheets

(56) References Cited

U.S. PATENT DOCUMENTS

| | | | |
|---|---|---|---|
| 2009/0183883 | A1 | 7/2009 | Fontenot et al. |
| 2009/0184278 | A1 | 7/2009 | Beall et al. |
| 2015/0275605 | A1 | 10/2015 | Bennett et al. |
| 2019/0024480 | A1 | 1/2019 | Thomson et al. |

* cited by examiner

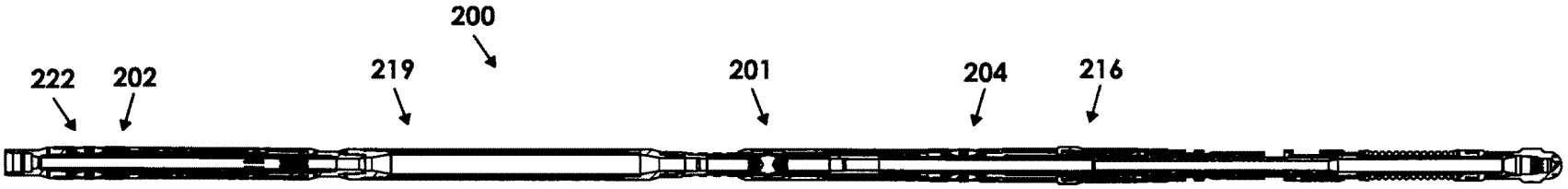
FIG. 17
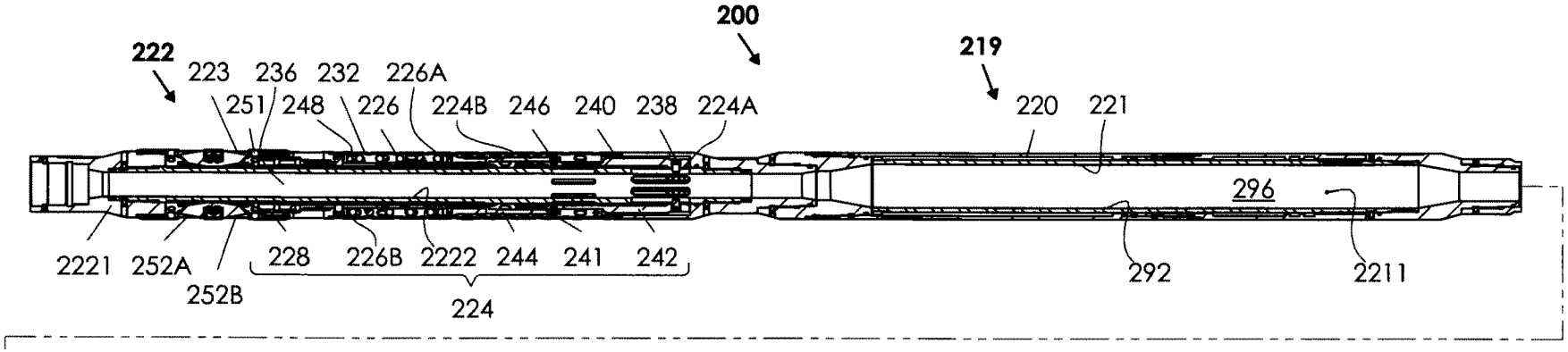
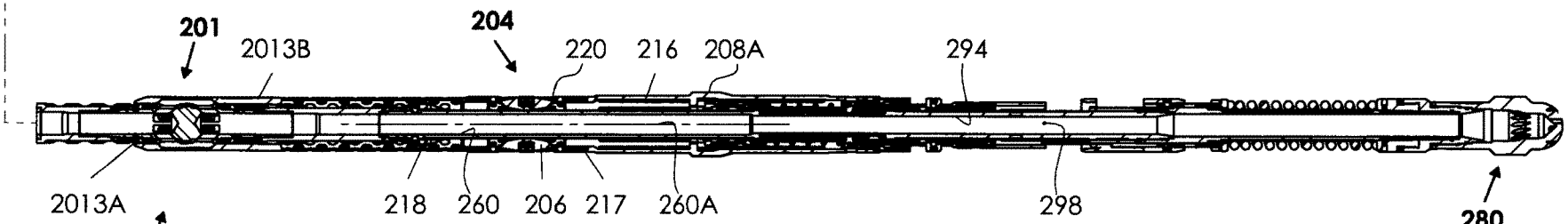
FIG. 18

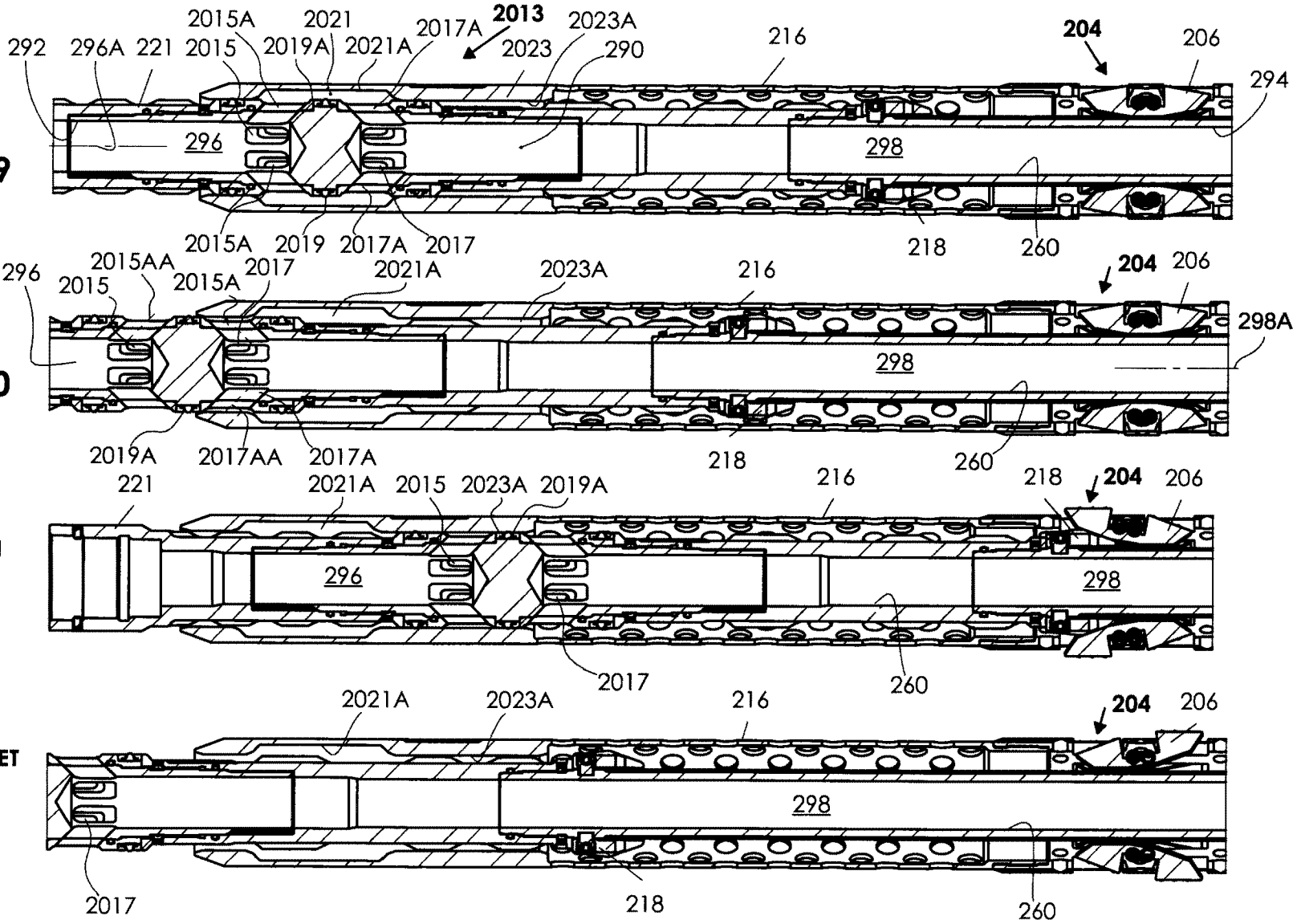
294
206
204
260
218
298
216
2023A
290
2013
2023
2017A
2017
2021A
2021
2019A
2019
2015A
2015
221
296A
292
296
298A
2017AA
2015AA
218
2017
2019A
221
2015
2023A
2021A
2017A
2017
2019A
2023A
2015
2021A
2017A
2017
2023A
2021A
2017
2017
2017

BOTTOMHOLE ASSEMBLY

CROSS REFERENCE TO RELATED APPLICATIONS

This application is a U.S. National Stage Application filed under 35 U.S.C. § 371 and claims priority from International Application No. PCT/CA2020/050088, filed Jan. 24, 2020, which application claims the benefit of U.S. Provisional Application No. 62/817,851, filed Mar. 13, 2019, the disclosures of which are incorporated herein in their entirety by reference.

FIELD

The present disclosure relates to downhole tools for performing wellbore operations.

BACKGROUND

Multiple wellbore operations are typically required to stimulate and produce hydrocarbon material from a subterranean formation. It is desirable for a single tool to be available that is able perform more than one of these operations in a controlled manner.

SUMMARY

In one aspect, there is provided a bottomhole assembly, configured for coupling to a conveyance system for downhole deployment within a wellbore, wherein the conveyance system defines a fluid passage, comprising:

an actuator tool including an anchoring tool and a linear actuator;

wherein:

the coupling is such that the actuator tool is disposed in fluid communication with the fluid passage;

the actuator tool is configurable in first and second force transmission states;

in the first force transmission state, there is an absence of actuation of the anchoring tool;

in the second force transmission state, the anchoring tool is disposed in an actuated state for retention relative to the wellbore; and while the coupling of the bottomhole assembly and the conveyance system is established within the wellbore:

while the actuator tool is disposed in the first force transmission state, the actuator tool is disposed for receiving transmission of a compressive force being applied to the conveyance system from the surface, and transmitting the compressive force for effecting a first wellbore operation; and while the actuator tool is disposed in the second transmission state, and the anchoring tool is being retained relative to the wellbore, the linear actuator is actuatable, in response to receiving a fluid pressure force that is communicated via the fluid passage of the conveyance system, for effecting a second wellbore operation.

In another aspect, there is provided a bottomhole assembly, configured for coupling to a conveyance system for downhole deployment within a wellbore, wherein the conveyance system defines a fluid passage, comprising:

an actuator tool including an anchoring tool;

wherein:

the coupling of the bottomhole assembly and the conveyance system is such that the actuator tool is disposed in fluid communication with the fluid; and while the coupling of the bottomhole assembly and the conveyance system is established within the wellbore:

the actuator tool is disposed for receiving transmission of a compressive force being applied to the conveyance system from the surface, and transmitting the compressive force for effecting a first wellbore operation; and actuation of the anchoring tool, for effecting retention of the anchoring tool relative to the wellbore, is effectible in response to a fluid pressure force that is communicated via the fluid passage of the conveyance system.

In another aspect, there is provided a bottomhole assembly, configured for coupling to a conveyance system for downhole deployment within a wellbore, wherein the conveyance system defines a fluid passage, comprising:

a flow communicator for circulating, within the wellbore, fluid that is conducted from the surface via the fluid passage;

a flow controller for occluding the flow communicator; and a wellbore tool;

wherein:

the flow communicator, the flow controller, and the wellbore tool are co-operatively configured such that, while the flow communicator is occluded by the flow controller, the wellbore tool is responsive to a fluid pressure force, that is communicated via the fluid passage of the conveyance system, for effecting a hydraulically-actuated wellbore operation.

In another aspect, there is provided a bottomhole assembly, configured for coupling to a conveyance system for downhole deployment within a wellbore, wherein the conveyance system defines a fluid passage, comprising:

a valve; and a wellbore tool;

wherein:

the valve is configurable in a circulation configuration and an actuation-facilitating configuration;

while the valve is disposed in a circulation configuration, flow communication is established between the fluid passage and an environment external to the bottomhole assembly; and while the valve is disposed in an actuation-facilitating configuration, flow communication, between the fluid passage and the environment external to the bottomhole assembly, is sufficiently occluded, with effect that the wellbore tool is responsive to a fluid pressure force, that is communicated via the fluid passage, for effecting a hydraulically-actuated wellbore operation.

In another aspect, there is provided a bottomhole assembly, configured for coupling to a conveyance system for downhole deployment within a wellbore, wherein the conveyance system defines a fluid passage, comprising:

an uphole passage for disposition in flow communication with the fluid passage of the conveyance system while the bottomhole assembly is coupled to the conveyance system;

a downhole passage;

a valve for controlling flow communication between the uphole passage and the downhole passage; and a wellbore tool; and a clean-out flow communicator, disposed in flow communication with the downhole passage, for discharging fluid, that is being conducted via the downhole passage, externally of the bottomhole assembly, and for receiving fluid flow externally of the bottomhole assembly;

wherein:

the valve is configurable in at least a flow-through configuration and an actuation-facilitating configuration;

while the valve is disposed in a flow-through configuration:

bypass of the downhole passage, by fluid flow that is being conducted downhole via the uphole passage, is prevented, such that the fluid flow is conductible downhole, via the downhole passage, to the clean-out flow communicator; and bypass of the uphole passage, by fluid flow that is being conducted uphole, via the downhole passage, from the clean-out flow communicator, is prevented, such that the fluid flow is conductible uphole, via the uphole passage;

and while the valve is disposed in an actuation-facilitating condition, flow communication, between the uphole passage and the downhole passage is sufficiently occluded with effect that the wellbore tool is responsive to a force applied by pressurized fluid, that is communicated via the fluid passage of the conveyance system, for effecting a hydraulically-actuated wellbore operation.

In another aspect, there is provided a bottomhole assembly configured for coupling to a conveyance system for downhole deployment within a wellbore such that a wellbore space is defined externally of the bottom hole assembly, comprising;

a body including a central longitudinal axis; and a resilient pressure differential-establishing member;

wherein:

the resilient pressure differential-establishing member is secured to the body;

the resilient pressure differential-establishing member is configurable in a retracted state and an extended state;

relative to the retracted state, in the extended state, the resilient pressure differential-establishing member is disposed further outwardly relative to the central longitudinal axis of the body;

the resilient pressure differential-establishing member is transitionable from the retracted state to the extended state in response to receiving application of a force from pressurized fluid disposed within the wellbore space; and while: (i) the bottomhole assembly is disposed within a wellbore, (ii) the resilient pressure differential-establishing member is disposed in the extended state, and (iii) pressurized fluid is disposed within the wellbore space:

a pressure differential is established across the resilient pressure differential-establishing member, with effect that displacement of the bottomhole assembly is urged in a downhole direction within the wellbore.

BRIEF DESCRIPTION OF DRAWINGS

Reference will now be made, by way of example, to the accompanying drawings which show example embodiments of the present application, and in which:

FIG. 17 is a sectional view of another embodiment of a bottomhole assembly, disposed in the run-in-hole state;

FIG. 18 is an enlarged sectional view of the bottomhole assembly illustrated in FIG. 18, disposed in a run-in-hole state, with the bottomhole assembly illustrated in sections;

FIGS. 19 to 22 are sectional views of a section of the bottomhole assembly illustrated in FIGS. 17 and 18, including the valve and shifting tool, illustrated in a run-in-hole state (FIG. 19), a pull-out-of-hole state (FIG. 20), a set down state (FIG. 21), and a tension set state (FIG. 22)

DETAILED DESCRIPTION

Figure 8:
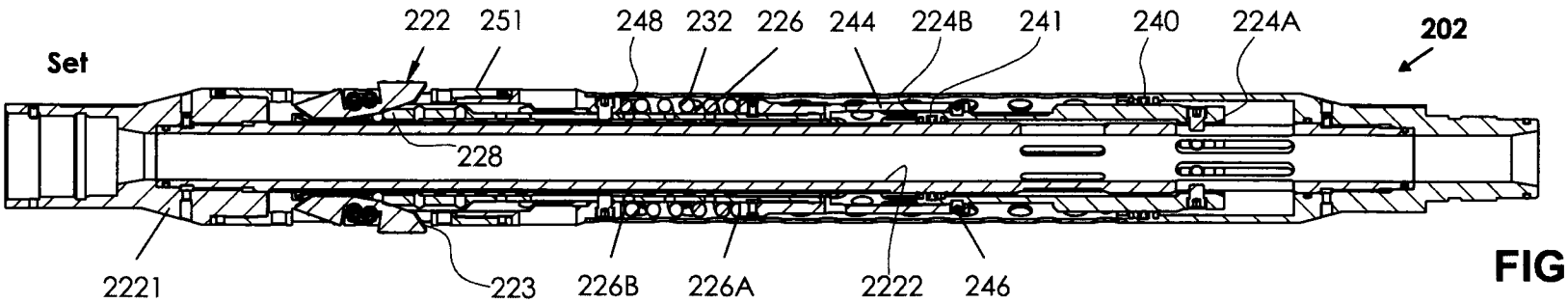
Figure 10:
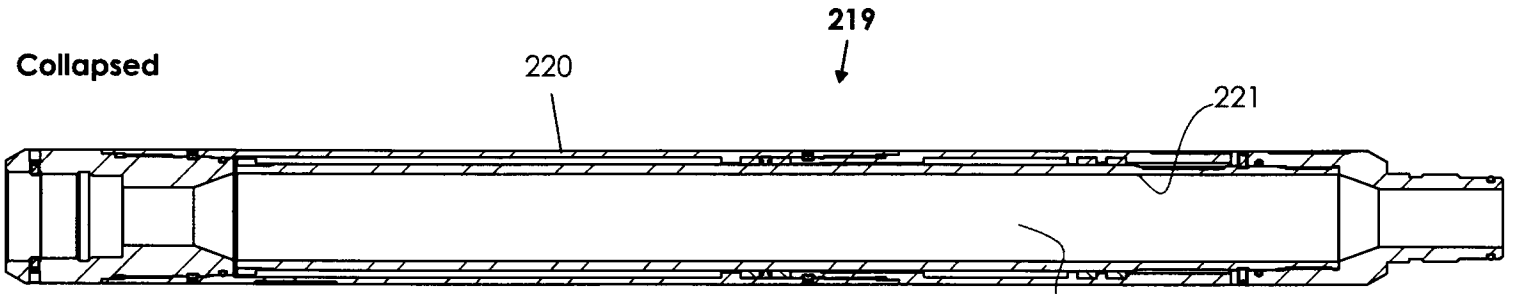
FIGS. 10 and 11 are sectional views of the linear actuator of the bottomhole assembly of FIG. 3, illustrated in retracted (FIG. 10) and extended (FIG. 11) states.
Figure 11:
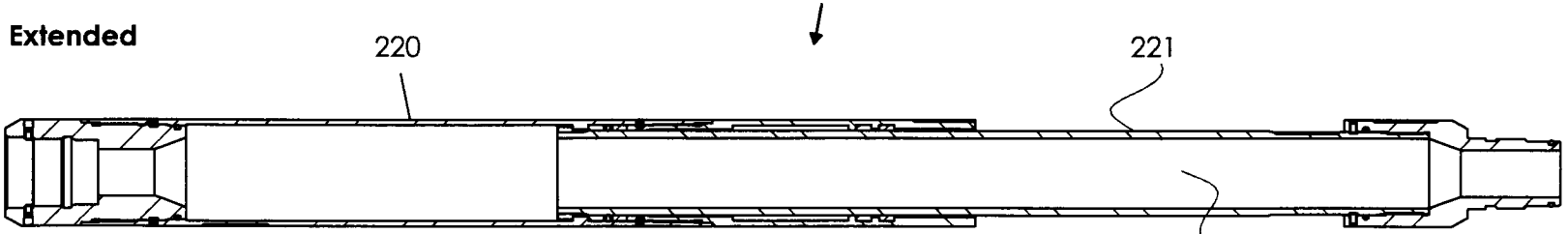

Referring to FIGS. 1 to 22, there is provided a bottomhole assembly 200 that is deployable downhole within a wellbore 100 via a conveyance system 300. The conveyance system 300 includes a fluid conductor 302 for effecting fluid communication between the surface 12 and the bottomhole assembly 200. The bottomhole assembly 200 includes an actuator tool 202 and a shifting tool 204. In some embodiments, for example, the actuator tool 202 is disposed for receiving transmission of a compressive force being applied to the conveyance system from the surface 12, and transmitting the compressive force for actuating the shifting tool 204 (see FIG. 5). In some embodiments, for example, the actuator includes an anchoring tool 222 configured for hydraulic actuation, via fluid pressure forces communicated by the fluid conductor 302 of the conveyance system 300, for becoming retained relative to the wellbore string 102 (see FIG. 8). In some embodiments, for example, the actuator tool 202 also includes a linear actuator 219 that is extendible relative to the anchoring tool 222 (see FIGS. 10 and 11), while the anchoring tool 222 is retained relative to the wellbore string 102, for transmitting a force to the actuated shifting tool 204 with effect that the shifting tool 204 is displaced relative to the wellbore 100. In some embodiments, for example, the transmitting a force to the actuated shifting tool 204 with effect that the shifting tool 204 effects the movement of a wellbore feature 106, such as, for example, a flow controller 116 (see FIGS. 6 and 15). In some embodiments, for example, the extension of the linear actuator 219 is hydraulically actuated via fluid pressure forces communicated by the fluid conductor 302 of the conveyance system 300. In some embodiments, for example, the bottomhole assembly 200 includes a valve 201 that is configurable in a plurality of configurations. In some embodiments, for example, the valve is configurable in a circulation configuration for facilitating circulation of fluid within the wellbore (see FIGS. 3, 4, 6, 12, 20, and 22), and is also configurable in an actuation-facilitating configuration for facilitating hydraulic actuation operations (see FIGS. 5, 13, and 21). In some embodiments, for example, the valve is additionally configurable in a flow-through configuration for facilitating wellbore clean-out operations (see FIGS. 17, 18, and 19). In some embodiments, for example, the bottomhole assembly is deployable downhole within a wellbore in response to force applied by pressurized fluid.

In some embodiments, for example, the flow controller 116 is a sliding sleeve. Exemplary ones of the flow controller 116 that are suitable for manipulation by the bottomhole assembly 200 include those disclosed in International Patent Publication No. WO 2018/161158 A1. This includes the flow control member that is identified in that patent publication by reference numeral 216, which may be difficult to successfully manipulate (e.g. displace) with conventional shifting tools, due to its relatively short length.

Figure 1:
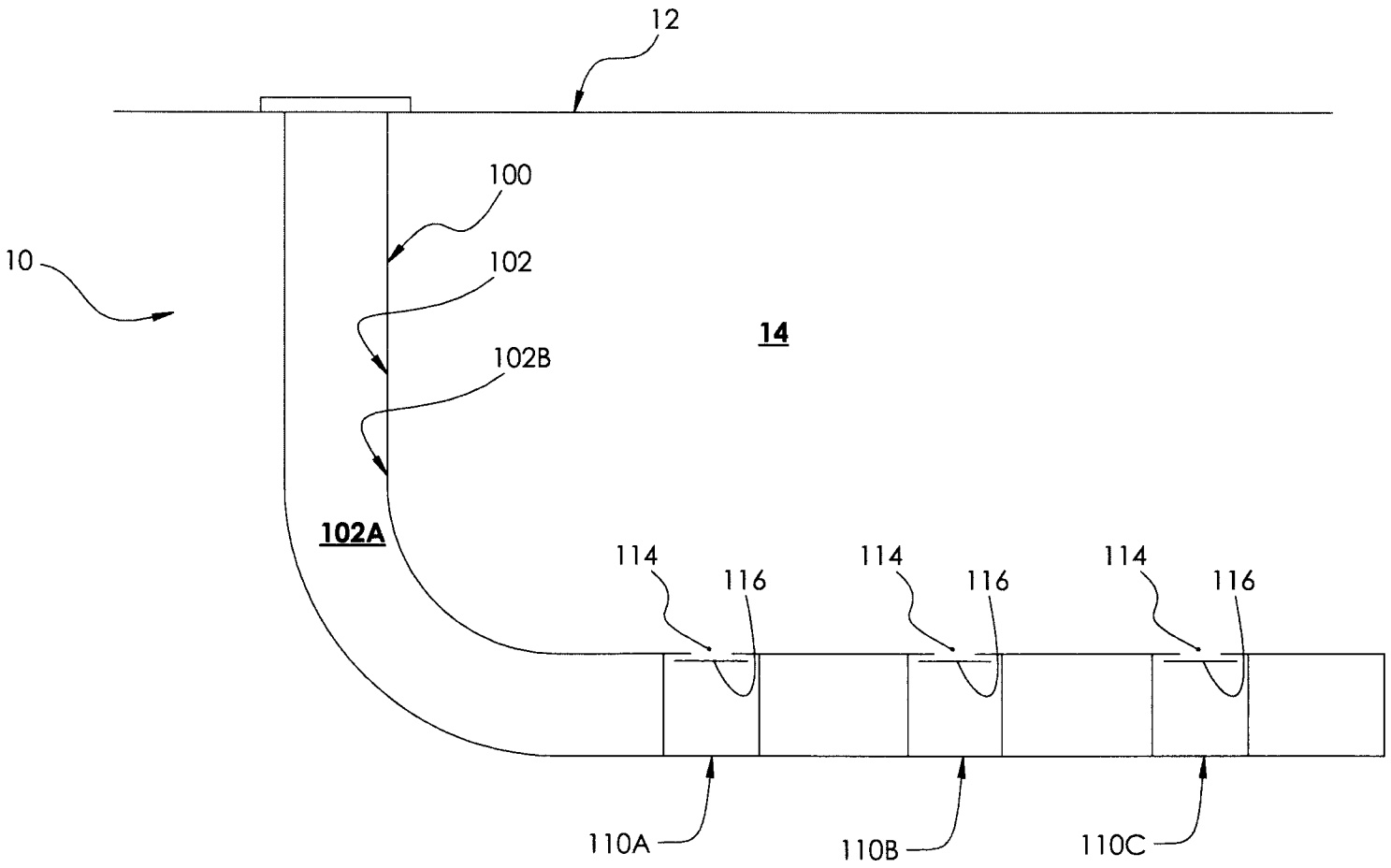
FIG. 1 is a schematic of a system for effecting production of hydrocarbon material from a subterranean formation.

Referring to FIG. 1, there is provided a wellbore material transfer system 10 for conducting material from the surface 12 to a subterranean formation 14 via the wellbore 100, or from the subterranean formation 14 to the surface 12 via the wellbore 100, or between the surface 12 and the subterranean formation 14 via the wellbore 100. In some embodiments, for example, the subterranean formation 14 is a reservoir that contains hydrocarbon material.

The wellbore 100 can be straight, curved, or branched. The wellbore 100 can have various wellbore sections. A wellbore section is an axial length of the wellbore 100. A wellbore section can be characterized as "vertical" or "horizontal" even though the actual axial orientation can vary from true vertical or true horizontal, and even though the axial path can tend to "corkscrew" or otherwise vary. The term "horizontal", when used to describe a wellbore section, refers to a horizontal or highly deviated wellbore section as understood in the art, such as, for example, a wellbore section having a longitudinal axis that is between 70 and 110 degrees from vertical.

In one aspect, there is provided a process for stimulating hydrocarbon production from the subterranean formation 14. The process includes, amongst other things, conducting treatment material from the surface 12 to the subterranean formation 14 via the wellbore 100.

In some embodiments, for example, the conducting (such as, for example, by flowing) treatment material to the subterranean formation 14 via the wellbore 100 is for effecting selective stimulation of the subterranean formation 14, such as a subterranean formation 14 including a hydrocarbon material-containing reservoir. The stimulation is effected by supplying the treatment material to the subterranean formation 14. In some embodiments, for example, the treatment material includes a liquid, such as a liquid including water. In some embodiments, for example, the liquid includes water and chemical additives. In other embodiments, for example, the stimulation material is a slurry including water and solid particulate matter, such as proppant. In some embodiments, for example the treatment material includes chemical additives. Exemplary chemical additives include acids, sodium chloride, polyacrylamide, ethylene glycol, borate salts, sodium and potassium carbonates, glutaraldehyde, guar gum and other water-soluble gels, citric acid, and isopropanol. In some embodiments, for example, the treatment material is supplied to effect hydraulic fracturing of the reservoir.

In some embodiments, for example, the conducting of fluid, to and from the wellhead, is effected via the wellbore string 102. The wellbore string 102 may include pipe, casing, or liner, and may also include various forms of tubular segments. The wellbore string 102 includes a wellbore string passage 102A.

In some embodiments, for example, the wellbore 100 includes a cased-hole completion, in which case, the wellbore string 102 includes a casing 102B.

A cased-hole completion involves running casing down into the wellbore 100 through the production zone. The casing 102B at least contributes to the stabilization of the subterranean formation 14 after the wellbore 100 has been completed, by at least contributing to the prevention of the collapse of the subterranean formation 14 that is defining the wellbore 100. In some embodiments, for example, the casing 102B includes one or more successively deployed concentric casing strings, each one of which is positioned within the wellbore 100, having one end extending from the wellhead. In this respect, the casing strings are typically run back up to the surface 12. In some embodiments, for example, each casing string includes a plurality of jointed segments of pipe. The jointed segments of pipe typically have threaded connections.

The annular region between the deployed casing 102B and the subterranean formation 14 may be filled with zonal isolation material for effecting zonal isolation. The zonal isolation material is disposed between the casing 102B and the subterranean formation 14 for the purpose of effecting isolation of one or more zones of the subterranean formation from fluids disposed in another zone of the subterranean formation. Such fluids include formation fluid being produced from another zone of the subterranean formation 14 (in some embodiments, for example, such formation fluid being flowed through a production string disposed within and extending through the casing 102B to the surface 12), or injected stimulation material. In this respect, in some embodiments, for example, the zonal isolation material is provided for effecting sealing of flow communication between one or more zones of the subterranean formation and one or more others zones of the subterranean formation via space between the casing 102B and the subterranean formation 14. By effecting the sealing of such flow communication, isolation of one or more zones of the subterranean formation 14, from another subterranean zone (such as a producing formation) via the zonal isolation material is achieved. Such isolation is desirable, for example, for mitigating contamination of a water table within the subterranean formation by the formation fluids (e.g. oil, gas, salt water, or combinations thereof) being produced, or the above-described injected fluids.

In some embodiments, for example, the zonal isolation material is disposed as a sheath within an annular region between the casing 102B and the subterranean formation 14. In some embodiments, for example, the zonal isolation material is bonded to both of the casing 102B and the subterranean formation 14. In some embodiments, for example, the zonal isolation material also provides one or more of the following functions: (a) strengthens and reinforces the structural integrity of the wellbore, (b) prevents produced formation fluids of one zone from being diluted by water from other zones. (c) mitigates corrosion of the casing 102B, and (d) at least contributes to the support of the casing 102B. The zonal isolation material is introduced to an annular region between the casing 102B and the subterranean formation 14 after the subject casing 102B has been run into the wellbore 100. In some embodiments, for example, the zonal isolation material includes cement.

In some embodiments, for example, the conduction of fluids between the surface 12 and the subterranean formation 14 is effected via the passage 102A of the wellbore string 102.

In some embodiments, for example, the conducting of the treatment material to the subterranean formation 14 from the surface 12 via the wellbore 100, or of hydrocarbon material from the subterranean formation 14 to the surface 12 via the wellbore 100, is effected via one or more flow communication stations (three flow communication stations 110A, 110B, 110C are illustrated) that are disposed at the interface between the subterranean formation 14 and the wellbore 100. Successive flow communication stations 110A, 110B, 110C may be spaced from each other along the wellbore 100 such that each one of the flow communication stations 110A, 110B, 110C, independently, is positioned adjacent a zone or interval of the subterranean formation 14 for effecting flow communication between the wellbore 100 and the zone (or interval).

For effecting the flow communication, each one of the flow communication stations 110A, 110B, 110C includes a flow communicator 114 through which the conducting of the material is effected. In some embodiments, for example, the flow communicator is disposed within a sub that has been integrated within the wellbore string 102, and is pre-existing, in that the flow communicator 114 exists before the sub, along with the wellbore string 102, has been installed downhole within the wellbore 100. In some embodiments, for example, the flow communicator 114 is defined by one or more ports. Conducting of material between the wellbore 100 and the subterranean formation 14, via the flow communicator 114, is regulated by a flow controller 116.

Figure 2:
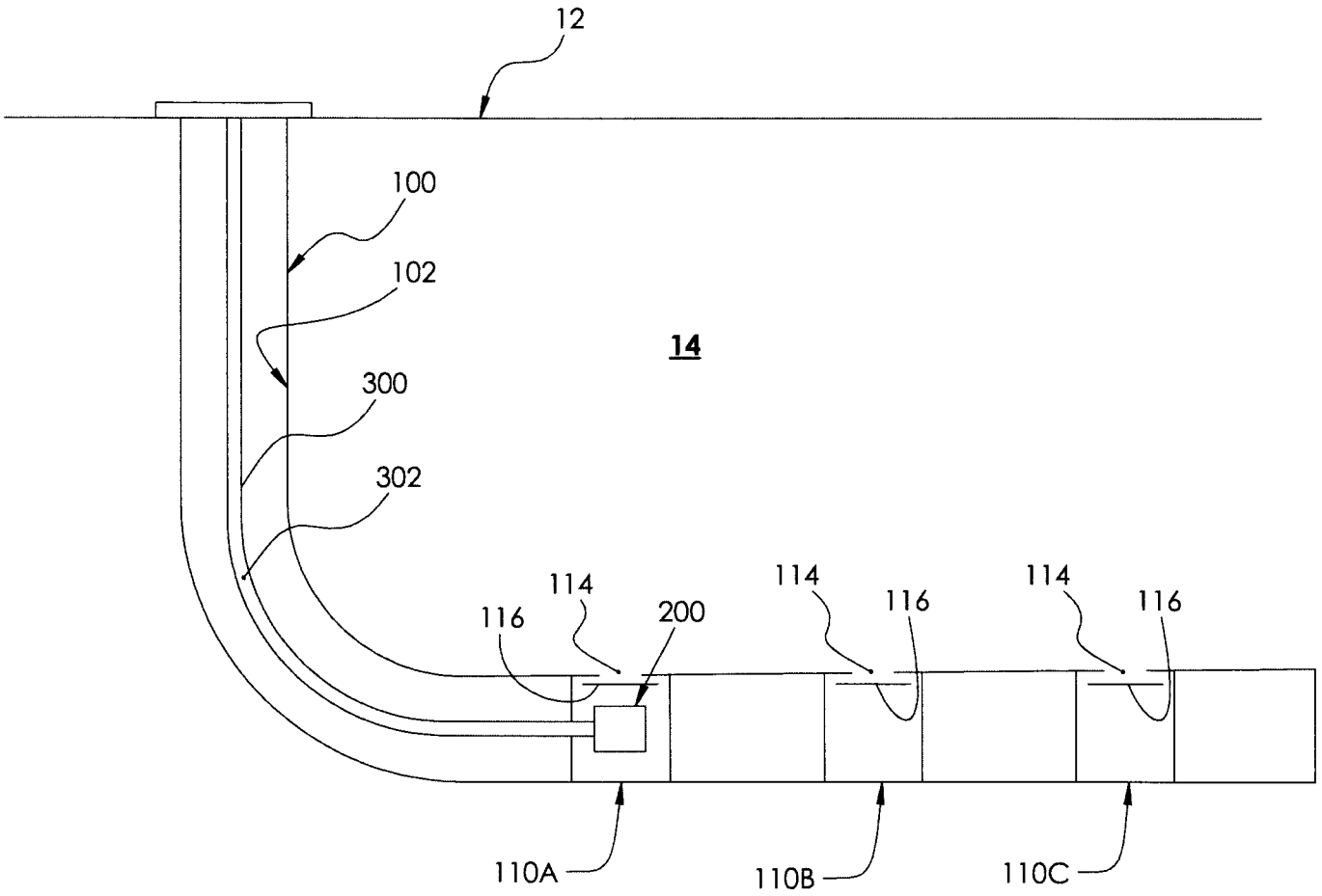
FIG. 2 is a schematic of a system for effecting production of hydrocarbon material from a subterranean formation, with a bottomhole assembly having been deployed within the wellbore.

Referring to FIG. 2, the bottomhole assembly 200 is provided for deployment within a wellbore 100 for effecting manipulation of a wellbore feature 106 disposed within the wellbore 100. The bottomhole assembly 200 is deployable downhole via the conveyance system 300. The conveyance system includes the fluid conductor 302 which effects fluid communication between the surface 12 and the bottomhole assembly 200. In some embodiments, for example, the conveyance system 300 is a workstring. In some embodiments, for example, the conveyance system 300 includes coiled tubing. The conveyance system 300 is co-operatively coupled to the bottomhole assembly 200 such that the bottomhole assembly 200 translates with the conveyance system 300. While the bottomhole assembly 200 is deployed within the wellbore 100, a wellbore annulus 118 is defined between the bottomhole assembly 200 and the wellbore string 102.

As described above, the bottomhole assembly 200 includes the actuator tool 202 and the shifting tool 204.

Referring to FIGS. 7, 8, 17, and 18, the actuator tool 202 is configurable in a first force transmission state and a second force transmission state.

In the first force transmission state (see FIGS. 7, 17 and 18), there is an absence of retention of the anchoring tool relative to the wellbore string 102, and the actuator tool 202 is disposed for applying a first force to the shifting tool 204 in the downhole direction in response to a compressive force applied to the conveyance system 300 from the surface 12, such as via an injector (e.g. in the case of coiled tubing, a coiled tubing injector).

In the second force transmission state (see FIG. 8), the anchoring tool 222 is actuated. While the anchoring tool 222 is actuated and being retained relative to the wellbore string 102, the linear actuator 222 is disposed for applying a second force to the shifting tool 204 in the downhole direction, in response to receiving a fluid pressure force that is communicated via fluid disposed within the fluid conductor 302 of the conveyance system 300. In some embodiments, for example, the second force is greater than the first force.

Figure 12:
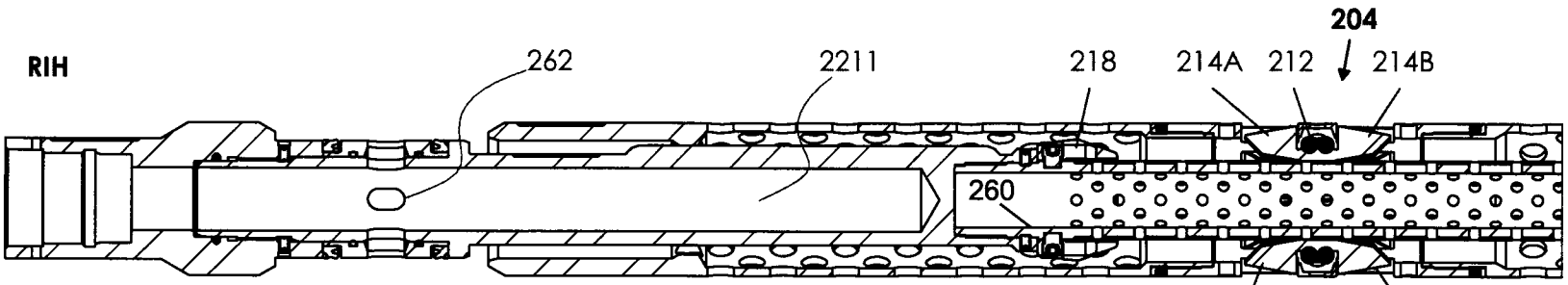
FIGS. 12 and 13 are sectional views of the shifting tool of the bottomhole assembly of FIG. 3, illustrated in a run-in-hole state (FIG. 12) and with the shifting tool having been actuated (FIG. 13)
Figure 13:
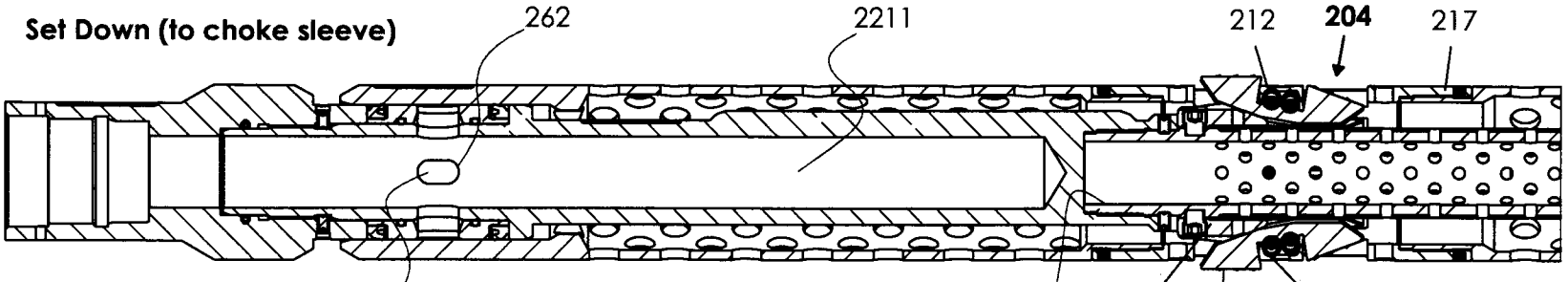
Figure 14:
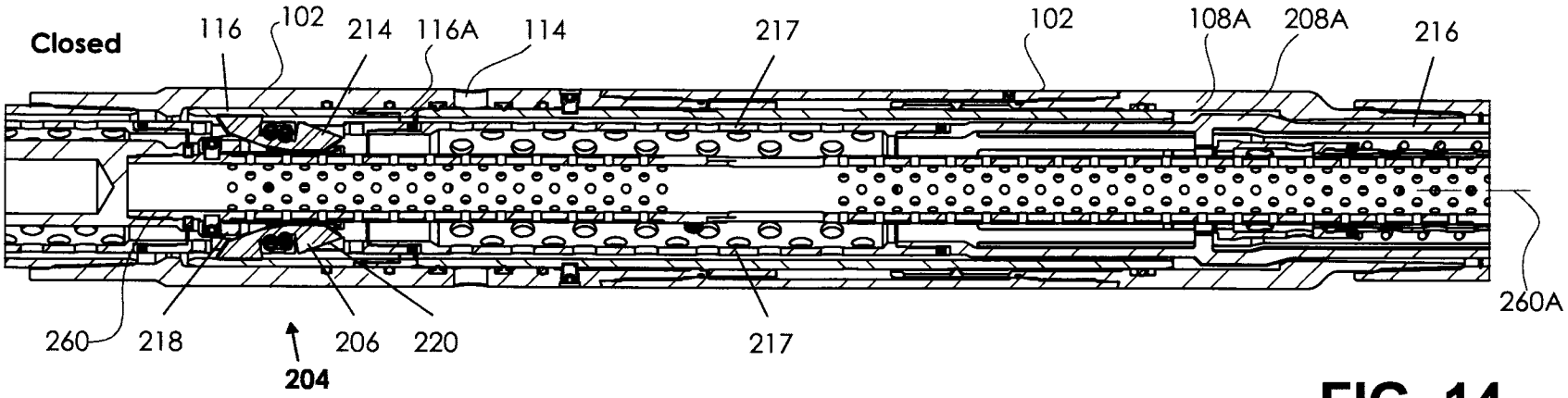
FIGS. 14 and 15 are sectional views of the shifting tool of the bottomhole assembly of FIG. 3, disposed within a wellbore string, and illustrated in an actuated state, prior to shifting of the flow controller (FIG. 14) and with the flow controller having been shifted by the shifting tool (FIG. 15)
Figure 15:
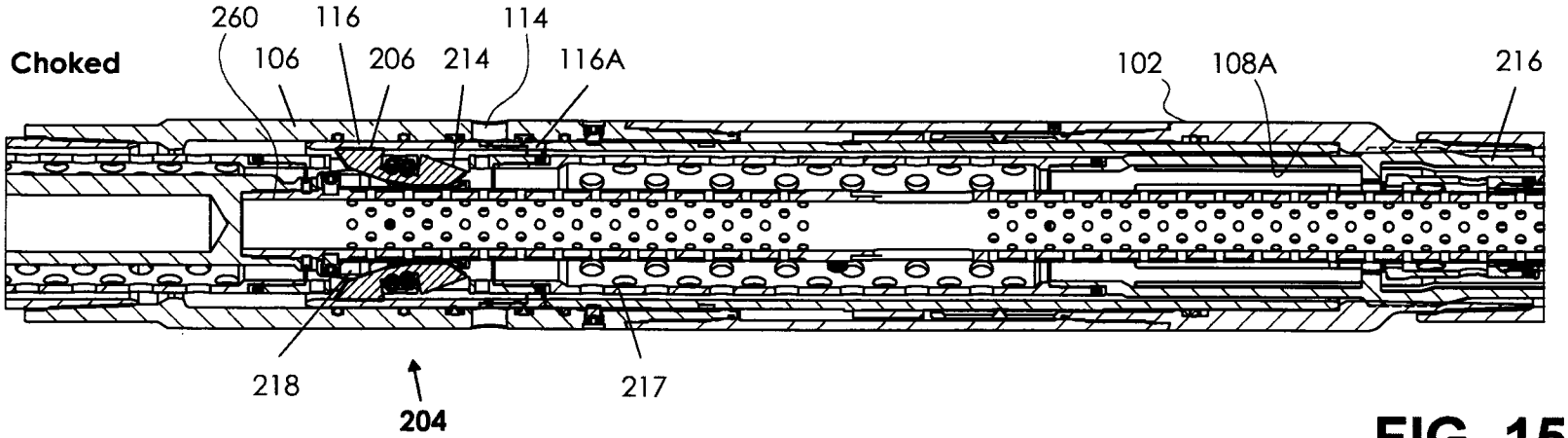

The shifting tool 204 is configurable in a retracted state (see FIG. 12) and in a shifting ready state (see FIGS. 13 and 14). The change in state from the retracted state to the shifting ready state is effected in response to an outwardly displacement of the shifting tool 204. The outwardly displacement of the shifting tool 204 is effectible in response to the application of the first force to the shifting tool 204 by the actuator tool 202, while the actuator tool 202 is disposed in the first force transmission state, and involves the co-operation of the wellbore string 102. In some embodiments, for example, the outwardly displacement is an outwardly displacement relative to an axis along which the force, applied by the actuator tool 202, and which urges the outwardly displacement, is applied. In some embodiments, for example, the change in state is effected within the wellbore 100, and the outward displacement is an outward displacement relative to the central longitudinal axis of the wellbore 100. While the shifting tool 204 is disposed in the shifting ready state, the shifting tool 204 is disposed for displacement in the downhole direction in response to the application of the second force to the shifting tool 204 by the actuator tool 202, while the actuator tool 202 is disposed in the second force transmission state.

Figure 5:
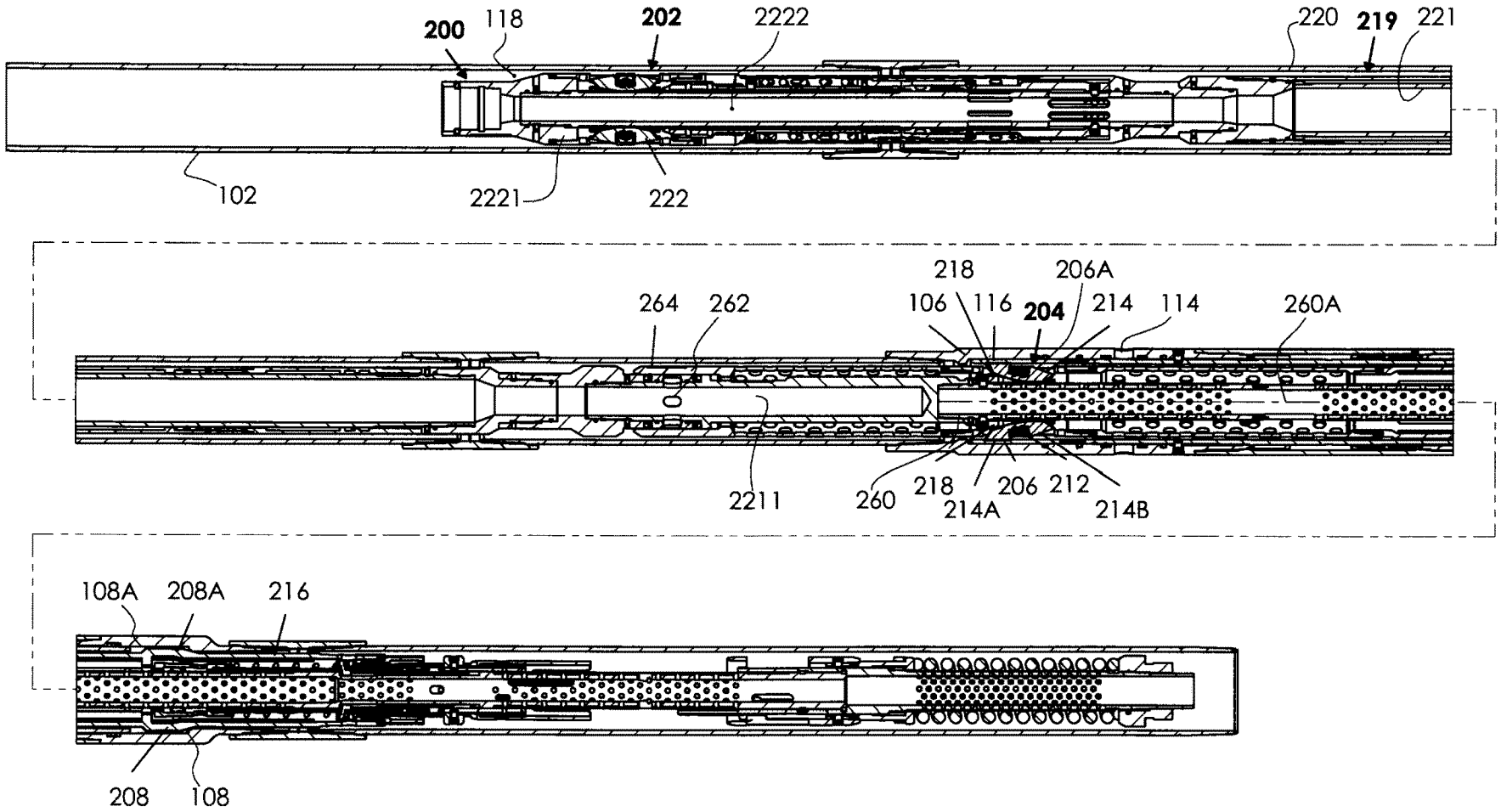
FIG. 5 is a sectional view of the bottomhole assembly of FIG. 3, illustrated in parts, disposed in the set down state within a wellbore string, with the shifting tool having been actuated but prior to actuation of the anchoring tool.
Figure 6:
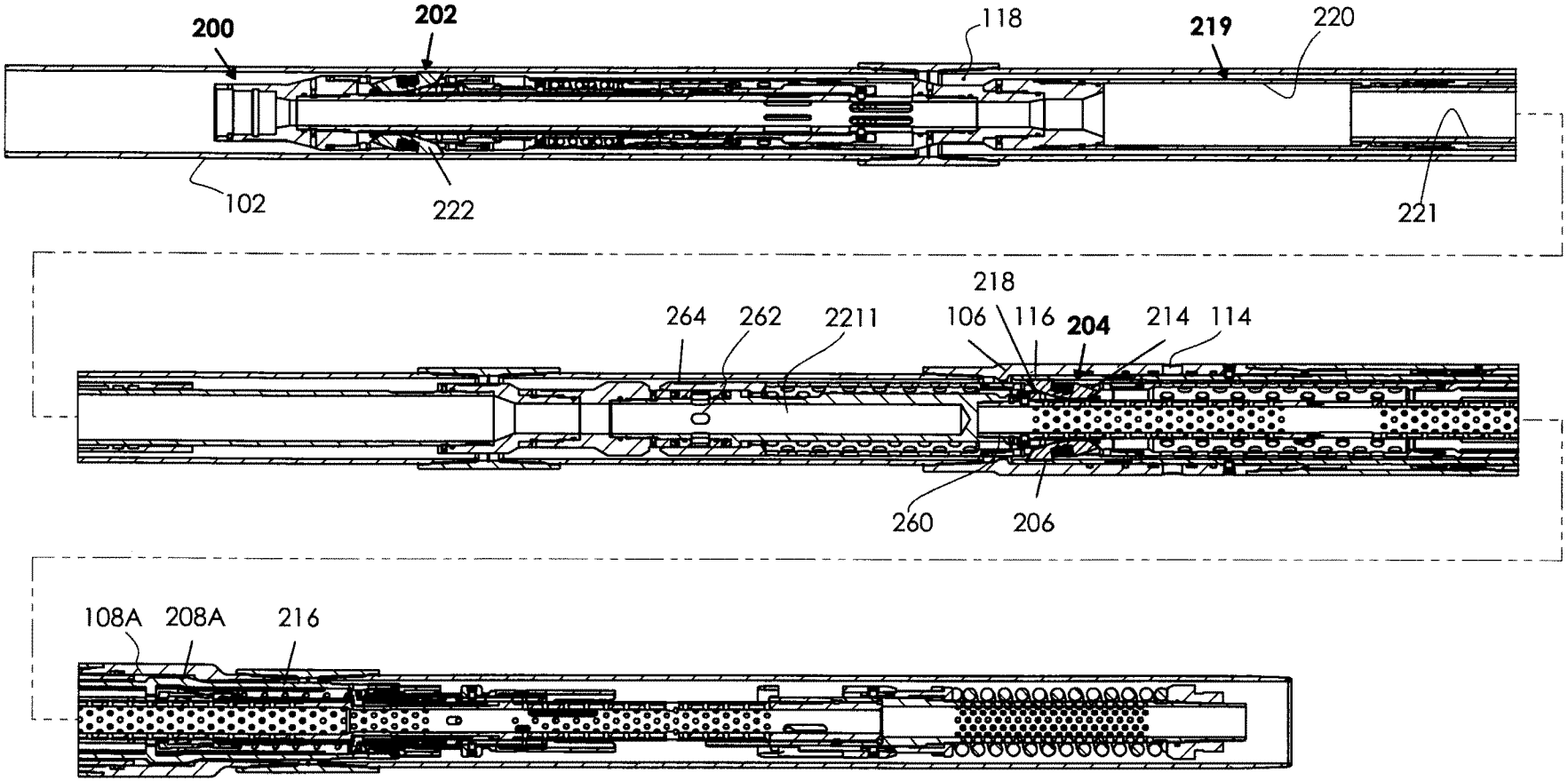
FIG. 6 a sectional view of the bottomhole assembly of FIG. 3, illustrated in parts, within a wellbore string, with the linear actuator having been actuated and having forced displacement of the shifting tool and the flow controller.
Figure 7:
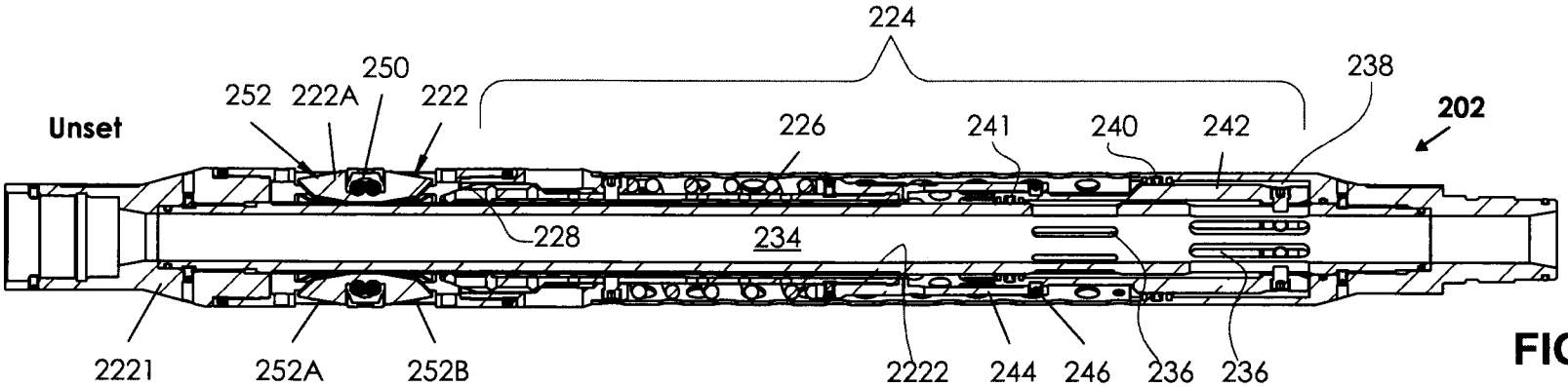
FIGS. 7, 8, and 9 are sectional views of the actuator tool of the bottomhole assembly of FIG. 3, illustrated in retracted (FIG. 7), actuated (FIG. 8), and "pins sheared" (FIG. 9) states.

Referring to FIGS. 5, 13, and 21, the actuator tool 202 is configured to co-operate with the shifting tool 204 and the conveyance system 300 such that, while the shifting tool 204 is disposed in the retracted state and the actuator 202 is disposed in the first force transmission state, a compressive force, applied to the conveyance system 300 from the surface 12, is transmittable to the shifting tool 204. The transmission of this force by the actuator tool 202 to the shifting tool 204, with effect that the shifting tool 204 changes from the retracted state to the shifting ready state, involves the co-operation of the wellbore string 102. In this respect, the actuator tool 202 and the shifting tool 204 are co-operatively configured such that, while:

(i) the bottomhole assembly 200 is disposed within the wellbore 100;

(ii) the actuator tool 202 is disposed in the first force transmission state;

(iii) the shifting tool 204 is disposed in the retracted state; and (iv) the compressive force is being applied to the conveyance system 300 from the surface 12;

the compressive force is transmitted by the actuator tool 202 to the shifting tool 204, and while the compressive force is being transmitted by the actuator tool 202 to the shifting tool 204, the wellbore string 102 and the shifting tool 204 are co-operating with effect that the shifting tool 204 changes state from the retracted state to the shifting ready state. In some embodiments, for example, the transmission of this compressive force is effected in response to engagement of the actuator tool 202 with the shifting tool 204.

In some embodiments, for example, the shifting tool 204 includes a shifter 206, and the transmitting by the actuator tool 202 to the shifting tool 204, of the compressive force applied to the conveyance system 200, is a transmission of the compressive force by the actuator tool 202 to the shifter 206. In this respect, the outwardly displacement of the shifting tool 204 includes an outwardly displacement of the shifter 206. The wellbore string 102 defines a wellbore feature 106 (such as, for example, a flow controller 116), and the shifter 206 is configured for interacting with the wellbore feature 106 for implementing a wellbore operation (for example, in some embodiments, where the wellbore feature 106 is a flow controller 116, the implemented wellbore operation is the opening or closing of a flow communicator 114).

Figure 4:
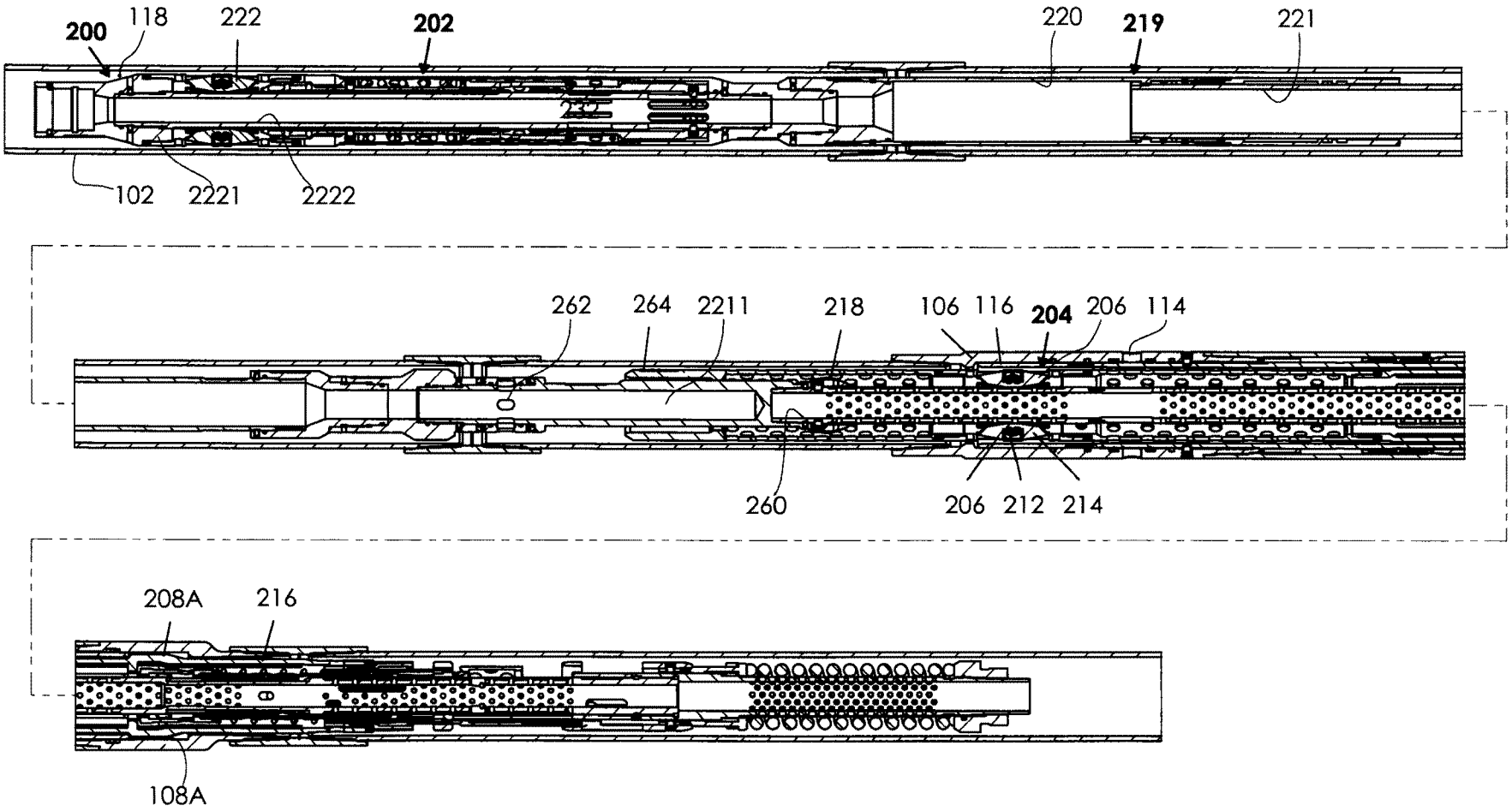
FIG. 4 is a sectional view of the bottomhole assembly of FIG. 3, illustrated in parts, disposed in the pull-out-of-hole state in a wellbore string with the locator having been located.

Referring to FIGS. 4, 17, and 18, the shifting tool 204 further includes a releasably retainable wellbore string engager 208. Correspondingly, the wellbore string 102 defines a profile 108, and the releasably retainable wellbore string engager 208 is disposed for becoming disposed within the profile 108 for effecting releasable retention of the shifting tool 204 relative to the wellbore string 102. In these embodiments, for example, the above-described co-operation between the shifting tool 204 and the wellbore string 102, which has the effect of encouraging the outwardly displacement of the shifter 206, in response to the transmission of the compressive force applied to the conveyance system 200, from the actuator tool 202 to the shifter 206 while the actuator tool 202 is disposed in the first transmissions state, includes the releasable retention of the shifting tool 204 relative to the wellbore string 102 effected by the disposition of the engager 206 within the profile 108. In some embodiments, for example, the releasable retention of the shifting tool 204 relative to the wellbore string 102 functions to interfere with displacement of the shifter 206, relative to the wellbore feature 106, in the direction of the force (e.g. the downhole direction), being applied by the shifting actuator 202 to the shifter 206 (such as, for example, along an axis that is parallel to the central longitudinal axis of the wellbore 100), and which is the transmission of the compressive force being applied to the conveyance system 300. In parallel, the profile 108 is co-operatively disposed relative to the wellbore feature 106 such that the outwardly displacement of the shifter 206 is with effect that the shifter 206 becomes suitably disposed relative to the wellbore feature 106 in the shifting-ready condition (in those embodiments where the wellbore feature 106 includes a flow controller 116, in some of these embodiments, for example, the suitable disposition is engagement of the shifter 206 to the flow controller 116), such that, upon further urging by the actuator tool 202 while the actuator tool 202 is disposed in the second force transmission state (see below), the shifter 206 transmits, to the wellbore feature, a further applied force being applied to the conveyance system for interacts with the wellbore feature 106 for effecting performance of a wellbore operation.

In some embodiments, for example, the actuator tool 202 includes a shifter-actuating mandrel 260, and the shifter 206 is in the form of a rocker 206A that is retained relative to the shifter-actuating mandrel 260 by a garter spring 212. The shifter-actuating mandrel 260 is displaceable relative to the shifter 206 along its central longitudinal axis 260A. In some embodiments, for example, the rocker 206A includes a plurality of mechanical slips 214, each of which, independently, includes pads 214A, 214B, that are fastened to one another by the garter spring. The garter spring 212 extends through grooves defined within the mechanical slips 214 and biases the shifter 206 to the retracted state. In those embodiments where the wellbore feature includes a flow controller 116, in some of these embodiments, for example, the pads 214A, 214B include a gripping surface for becoming disposed in gripping engagement with the flow controller 116.

In some embodiments, for example, the engager 208 is a locator 208A, and the profile 108 is a locate profile 108A, such that the engager 208 of the bottomhole assembly 200 is configured for locating the bottomhole assembly 200 within the wellbore 100. In some embodiments, for example, the locator 208A is defined by a locator mandrel 216. The locator mandrel 216 includes a slip cage 217 that defines apertures through which the pads 214A, 214B of the mechanical slips 214 extend, thereby retaining the shifter 206 relative to the locator mandrel 216. The retaining of the shifter 206 relative to the locator mandrel 216, while the locator 208A is disposed within the locate profile 204A and the shifter 206 is disposed in the retracted state, is with effect that the displacement of the shifter 206, relative to the wellbore feature 108, in the direction of the force (e.g. the downhole direction), being applied by the shifting tool actuator 202 to the shifter 206 via the shifter-actuating mandrel 260 (such as, for example, along an axis that is parallel to the central longitudinal axis of the wellbore 100), is thereby prevented, and, rather than being displaced in the direction of the force, the shifter 206 is forced in the outwardly direction. In this respect, the shifter 206 is disposed for outwardly displacement relative to the central longitudinal axis of the wellbore 100. Embodiments of suitable ones of locator 308A are illustrated in International Patent Publication No. WO 2017/079823 A1.

The actuator tool 202 includes a setting cone 218 that is mounted to the shifter-actuating mandrel 260. The setting cone 218 is configured for engaging the shifter 206. The shifter-actuating mandrel 260, the setting cone 218, the shifter 206, the locating mandrel 216, and the locator 208A are co-operatively configured such that, while:

(i) the bottomhole assembly 200 is disposed within the wellbore 100;

(ii) the actuator tool 202 is disposed in the first force transmission state;

(iii) the shifter 206, including mechanical slips 214 whose pads 214A, 214B extend through the apertures 220 of the slip cage 217, is disposed in the retracted state;

(iv) the setting cone 218 is disposed uphole relative to the shifter 206;

(iv) the compressive force is being applied to the shifter-actuating mandrel 260 by the conveyance system 300 from the surface 12; and (v) the locator 208A is disposed within the locate profile 108A (and thereby releasably retaining the shifting tool 204 relative to the wellbore string 102):

the shifter-actuating mandrel 260 is displaced, along its central longitudinal axis 260A, relative to the shifter 206 in a downhole direction such that the shifting cone 218 engages the shifter 206 and forces the shifter 206 in an outwardly direction relative to the central longitudinal axis 260A of the mandrel 260 such that the shifting tool 204 becomes disposed in the shifting ready state (see FIG. 14). In some embodiments, for example, the forcing of the shifter 206 in an outwardly direction is with effect that the shifter becomes engaged to the wellbore feature 106.

Referring to FIGS. 8, 10, 11, 17, and 18, as described above, in some embodiments, for example, the actuator tool 202 includes the linear actuator 219 and the anchoring tool 222. In some embodiments, for example, the linear actuator 219 is coupled to the shifter-actuating mandrel 260 such that the compressive force being applied to the conveyance system 300 from the surface 12, while the actuator tool 202 is disposed in the first force transmission state, is transmitted to the shifter-actuating mandrel 260 via the linear actuator 219.

Referring to FIGS. 7, 8, 17, and 18, to effect a change in state from the first force transmission state to the second force transmission state, the actuator tool 202 is further configured to co-operate with the conveyance system 300 such that, while the actuator tool 202 is disposed in the first force transmission state, in response to a fluid pressure differential, that is established in response to communication of a pressurized fluid, via the fluid conductor 302 of the conveyance system 300, to the actuator tool 202, the actuator tool 202 changes its state from the first force transmission state to the second force transmission state. As discussed above, in the second force transmission state, the anchoring tool 222 is disposed in an actuated state. In this state, and while disposed within the wellbore string 102, the anchoring tool 222 and the wellbore string 102 are co-operatively configured such that the anchoring tool 222 is retained relative to the wellbore string 102.

The anchoring tool 222 is configured for actuation, while the actuator tool 202 is disposed in the first force transmission state, in response to the establishment of a fluid pressure differential that is effectuated in response to receiving of a fluid pressure force that is communicated via fluid within the fluid conductor 302 of the conveyance system 300. In some embodiments, for example, the actuation of the anchoring tool 222 is with effect that the anchoring tool 222 becomes engaged to the wellbore string 102 and retained relative to the wellbore string 102.

In some embodiments, for example, the anchoring tool 222 includes an anchor 223. While the actuator tool 202 is disposed in the first force transmission state, the anchor 223 is disposed for outwardly displacement relative to the central longitudinal axis of the wellbore 100, for effecting the retaining of the anchoring tool 222 relative to the wellbore string 102. In this respect, the actuation of the anchoring tool 222 includes the outwardly displacement of the anchor 223 from a retracted state to an actuated state. For effecting the outwardly displacement, the anchoring tool 222 further includes a housing 2221, a conduit 2222, a pusher 224, a coil spring 226, and a shroud 232.

The housing 2221 is configured for coupling to the conveyance system 300. The housing 2221 defines the conduit 2222, and the conduit 2222 includes a fluid passage 234 for becoming disposed in fluid communication with the fluid conductor 302 of the conveyance system 300. In this respect, while the housing 2221 is coupled to the conveyance system 300, the fluid passage 234 is disposed for receiving communication of pressurized fluid from the surface 12 via the fluid conductor 302 of the conveyance system 300. The conduit 2222 includes an actuator fluid communicator 236 for effecting fluid communication with the pusher 224.

In some embodiments, for example, the housing 2221 defines a chamber 238 for receiving communication of pressurized fluid via the actuator fluid communicator 236. The pusher 224 is disposed in fluid pressure communication with the chamber 238, and is moveable, in response to a pressure differential which is established in response to the communication of pressurized fluid to the chamber 238, for effecting the outwardly displacement of the anchor 223, as will be further described below. For establishing the pressure differential between first and second faces 224A, 224B of the pusher 224, sealed interfaces 240, 241 are defined between the pusher 224 and the housing 2221. In some embodiments, for example, the sealed interface 240 is defined by a sealing member that is carried by the housing 2221, and the sealed interface 241 is defined by a sealing member that is carried by the pusher 224. The first face 224A receives communication of the pressurized fluid that is disposed within the chamber 236, and the second face 224B receives communication of fluid pressure within the annulus 118.

In some embodiments, for example, the pusher 224 includes a piston 242, a spring nut 244, and a setting cone 228. The piston 242 defines the first and second faces 224A, 224B for enabling movement of the piston 242 in response to the established pressure differential. The spring nut 244 is configured for translation with the piston 242 in response to urging by the pressurized fluid within the chamber 236. The piston 242 is coupled to the spring nut 244 via a frangible member 246, such as, for example, a shear pin. The spring nut 244 is threadably coupled to the setting cone 228. The setting cone 228 is disposed for being urged into engagement with the anchor 223 for effectuation of the actuated state of the anchor 223.

The shroud 232 is mounted over the housing 2221 for containing the anchor 223, the coil spring 226, and the setting cone 228. The coil spring 226 is interposed between the shroud 232 and the setting cone 228. The coil spring 226 includes first and second ends 226A, 226B. The first end 226A is disposed in engagement with the spring nut 244 for biasing the pusher 224 remotely from the anchor 223. The second end 226B is disposed in engagement with a shoulder 248 defined by the housing 2221.

In some embodiments, for example, the anchor 223 is in the form of a rocker 222A that is retained relative to the housing 2221 by a garter spring 250. In some embodiments, for example, the rocker 222A includes a plurality of mechanical slips 252 that are fastened to one another by the garter spring 250. Each one of the slips 252, independently, includes pads 252A, 252B. In some of these embodiments, for example, the pads 252A, 252B include a gripping surface for becoming disposed in gripping engagement with the wellbore string 102. The garter spring 250 extends through grooves defined within the mechanical slips 252 and biases the anchor 223 to the retracted state.

The shroud 232 includes a slip cage 251 that defines apertures through which the pads 252A, 252B of the mechanical slips 252 extend, thereby retaining the anchor 223 relative to the shroud 232. The retaining of the anchor 223 relative to the shroud 232 is with effect that the displacement of the anchor 223 in the direction of the force (e.g. the uphole direction), being applied by the pressurized force within the chamber 238 and transmitted to the anchor 223 via the pusher 224 and the setting cone 226 (such as, for example, along an axis that is parallel to the central longitudinal axis of the wellbore 100), is thereby prevented, and, rather than being displaced in the direction of the force, the anchor 223 is forced in the outwardly direction to the actuated state.

In the force transmission state, the anchor 223, the slip cage 250, the pusher 224, the setting cone 228, and the coil spring 226 are co-operatively configured such that, while there is an absence of sufficient pressure differential between the chamber 238 and the annulus 118, the coil spring 226 biases the pusher 224 remotely from the setting cone 228, such that there is an absence of force being applied to the anchor 223 for effecting the actuation of the anchor 223. As well, the anchor 223, the slip cage 250, the pusher 224, the setting cone 228, and the coil spring 226 are co-operatively configured such that, while a sufficient pressure differential is established between the chamber 238 and the annulus 118, in response to communication of pressurized fluid from the surface 12 to the chamber 238 via the conveyance system 300, the fluid passage 234, and the actuator fluid communicator 236, the pusher 234 overcomes the spring bias of the coil spring 226 and urges engagement of the setting cone 228 with the anchor 223, with effect that the outwardly displacement of the anchor 223 is forced by the setting cone 228 and in co-operation with the slip cage 251, such that the anchoring tool 222 becomes disposed in the actuated state and retained relative to the wellbore string 102. In this respect, the actuator tool 202 becomes disposed in the second force transmission state and its anchoring tool 222 becomes retained relative to the wellbore string 102.

Figure 9:
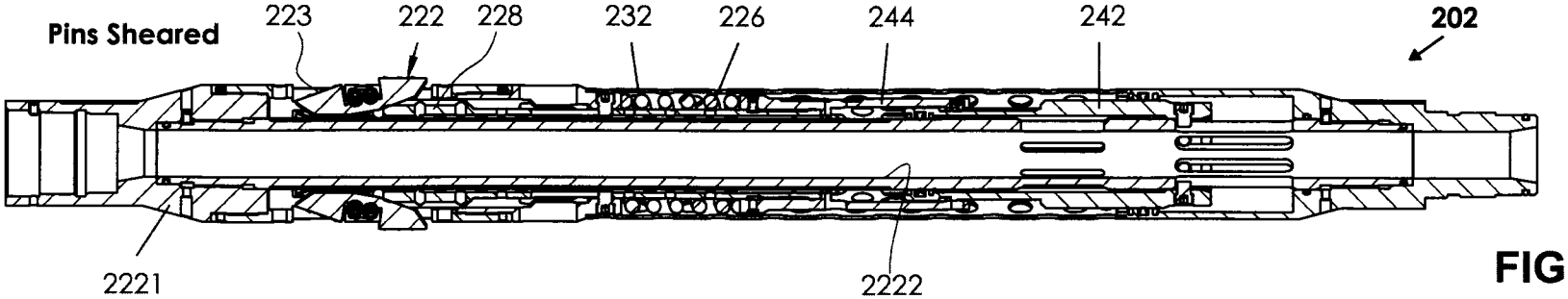

Referring to FIGS. 9, 17, and 18, the coupling of the piston 242 to the spring nut 244 with the frangible member 246 is for facilitating release of the anchor 223, in the event that the anchor 223 becomes stuck in an actuated condition. This release is effected by communicating sufficiently pressurized fluid to the chamber 238 (higher than that required to effect the actuation of the anchor 223, or to effect the wellbore operation described above) to effect fracturing of the frangible member 246, and thereby release the piston 242 from coupling to the spring nut 244. By becoming released from the piston 242, the spring nut 244 is free to be displaced remotely from the anchor 223 by the coil spring 226, which effects retraction of the setting cone 228 from the anchor 223, thereby permitting retraction of the anchor 223 from the actuated state (see below).

In some embodiments, for example, the actuation of the anchoring tool 222, such that the actuator tool 202 becomes disposed in the second force transmission state and the anchoring tool 222 becomes retained relative to the wellbore string 102, is effected while the shifting tool 204 is disposed in the shifting ready state. Upon the actuation of the anchoring tool 222 in these circumstances, the linear actuator 219 is now disposed to transmit a fluid pressure force, which is communicated via fluid within the fluid conductor 302 of the conveyance system 300, to the shifting tool 204, and, as a consequence, effect the downhole displacement of the shifting tool 204, relative to the wellbore 100.

Referring again to FIGS. 10, 11, 17, and 18, the linear actuator 219 includes a housing 220 and a moveable piston 221. The housing 220 is coupled to the anchoring tool 222, such that, while the anchoring tool 222 is retained relative to the wellbore string 102, the housing 220 is also retained relative to the wellbore string 202. The anchoring tool 222, the housing 220, and the piston 221 are co-operatively configured such that, while the anchoring tool 222 is retained relative to the wellbore string 102, the piston 221 is displaceable, relative to the housing 220, in the downhole direction, in response to receiving a fluid pressure force that is communicated via fluid within the fluid conductor 302 of the conveyance system 300.

In this respect, the actuator tool 202 is also configured to co-operate with the conveyance system 300 such that, while: (i) the actuator tool 202 is disposed in the second force transmission state, (ii) the anchoring tool 222 is engaged to the wellbore string 102, and (iii) the shifting tool 204 is disposed in the shifting ready state, a fluid pressure force, that is communicated via fluid within the fluid conductor 302 of the conveyance system 300 and received by the linear actuator 219, effects an extension of the linear actuator 219 for effecting transmission of the fluid pressure force to the shifting tool 204, with effect that the shifting tool 204 is displaced, relative to the wellbore 100, in the downhole direction.

In those embodiments where the wellbore feature 106 is a flow controller 116, and the shifting tool 204, in the shifting-ready state, is engaged to the flow controller 116, in some of these embodiments, for example, in response to the extension of the linear actuator 219, the flow controller 116 is displaced, relative to the flow communicator 114, by the shifting tool 204. In this respect, in some embodiments, for example, the actuation of the linear actuator 219 by the fluid pressure force effects opening of the flow communicator 114. In some embodiments, for example, the actuation of the linear actuator 219 by the fluid pressure force effects closing of the flow communicator 114.

As discussed above, the linear actuator 219 includes the housing 220 and the piston 221. The piston 221 is nested within the housing 220. The piston 221 is coupled to the shifter-actuating mandrel 260 such that the shifter-actuating mandrel 260 is translatable with the piston 221 for effecting transmission of force to the shifter 206. The piston 221 is disposed for displacement relative to the housing 220 in the downhole direction in response to receiving of fluid pressure force that is communicated via the conduit 222 (of the anchoring tool 222) and the fluid conductor 302 of the conveyance system 300. In this respect, in some embodiments, for example, the piston 221 is disposed in sealing engagement with the housing 220 so as to enable the establishment of a pressure differential across the piston 221 for effecting the displacement of the piston 221 relative to the housing 220.

While the shifting tool 204 is disposed in the shifting ready state, the actuator tool 202 is disposed in the second force transmission state, and the anchoring tool 222 is releasably retained relative to the wellbore string 102, in response to receiving a fluid pressure force that is communicated via the conduit 222 (of the anchoring tool 222) and the fluid conductor 302 of the conveyance system 300, the piston 221 is displaced, relative to the housing 220, such that the linear actuator 219 is, effectively, extended in the downhole direction. By virtue of its coupling to the piston 221, the shifter-actuating mandrel 260 translates with the linear actuator 219 and transmits a downhole-directed force to the shifter 206. If sufficient, the downhole-directed force urges the displacement of the shifter 206, relative to the wellbore 100, by translation with the shifter-actuating mandrel 260, thereby performing a wellbore operation. In those embodiments where the wellbore feature includes a flow controller 116 that is releasably retained to the wellbore string 102 with a retainer (such as, for example, a collet retainer or latch) and, in the actuated state, the shifter 206 is engaged to the flow controller 116, in order to effect the downhole displacement of the flow controller 116 with the shifter 206, the downhole-directed force is sufficient to effect release of the flow controller 116 from the retention relative to the wellbore string 102 and to effect release of the locator 208A from the locate profile 204A. In those embodiments where the wellbore feature includes a flow controller 116, the downhole displacement of the shifter 206 effects a change in condition of the flow communicator 114 which is associated with the flow controller 116. In some embodiments, for example, the change in condition can be an opening of the flow communicator 114. In some embodiments, for example, the change in condition can be a closing of the flow communicator 114.

In some embodiments, for example, while the bottomhole assembly 200 is deployed downhole, it is desirable to circulate fluid within the wellbore 100. Such circulation is desirable, for example, for removing solid debris from wellbore 100, or for mitigating the freezing of fluid disposed within the wellbore 100.

In this respect, in some embodiments, for example, and referring to FIGS. 3, 4, 12, 13, 17, and 18, the bottomhole assembly 200 further includes a valve 201 that is configurable in a circulation configuration (see FIGS. 3, 4, 12, 20, and 22) and an actuation-facilitating configuration (see FIGS. 13, 21). While the valve 201 is disposed in a circulation configuration, flow communication is established, via the fluid conductor 302 of the conveyance system 300, between the surface 12 and an environment external to the bottomhole assembly 200, such as, for example, the annulus 118, such that fluid flow circulation can be established. While the valve 201 is disposed in an actuation-facilitating configuration, flow communication, between the fluid passage and the annulus 118, is sufficiently occluded (e.g. closed), with effect that a wellbore tool is responsive to a fluid pressure force, that is communicated via the fluid conductor 202. In this respect, the valve 201 is provided for controlling flow communication between the bottomhole assembly 200 and the annulus 118. The controlling of such fluid communication includes occluding (e.g. sealing) such flow communication (see FIGS. 5, 6, 13, and 21) in those circumstances when it is desirable to supply a fluid pressure force, via the conveyance system 300, for effecting the change in state of the actuator 202 from the first force transmission state to the second force transmission state, or when it is desirable to supply a fluid pressure force, via the conveyance system 300, for effecting the displacement of the shifter 206 relative to the wellbore feature. Without such occlusion, sufficient fluid pressure force may not be deliverable via the conveyance system 300 for effecting these operations. In some embodiments, for example, these wellbore operations are only effectible while the valve is disposed in the actuation-facilitating configuration.

Referring to FIGS. 3, 4, 12, and 13, in some embodiments, for example, the valve 201 is a valve 2011 that includes a first valve counterpart 2011A and a second valve counterpart 2011B. The first valve counterpart 2011A includes a circulating flow communicator 262. In some embodiments, for example, the circulating flow communicator 262 is defined by a plurality of ports. In some embodiments, for example, the circulating flow communicator 262 is provided for conducting fluid, which is being supplied from the surface 12 via the annulus 118, for return to the surface 12 via the conveyance system 300, such that a fluid flow is thereby circulated within the wellbore 100 via the flow communicator 262. This is referred to as "reverse circulation". In some embodiments, for example, the circulating flow communicator 262 is provided for conducting fluid, which is being supplied from the surface 12 via the conveyance system 300, for return to the surface 12 via the annulus 118, such that a fluid flow is thereby circulated within the wellbore 100 via the flow communicator 262. This is referred to as "forward circulation".

In some embodiments, for example, the flow communicator 262 extends through the piston 221 and is disposed in flow communication with the fluid conductor 302 of the conveyance system 300 via the conduit 2222 and a piston chamber 2211. The second valve counterpart 2011B includes a flow controller 264 for controlling flow communication between the bottomhole assembly 200 and the annulus 118 via the flow communicator 262. In some embodiments, for example, the flow controller 264 is integral with the locator mandrel 216.

In this respect, the shifter-actuating mandrel 260, the flow communicator 262, and the flow controller 264 are cooperatively configured such that, the displacement of the shifter-actuating mandrel 260, in response to the compressive force being applied to the shifter-actuating mandrel 260 by the conveyance system 300 from the surface 12, which effects the outwardly displacement of the shifter 206 to the actuated state, also effects displacement of the flow controller 264 relative to the flow communicator 262, with effect that occlusion (e.g. closing) of the flow communicator 262 is effected by the flow controller 264. In some embodiments, for example, the occlusion of the flow communicator 262 is maintained while the shifter-actuating mandrel 260 is being displaced further downhole for effecting transmission of the fluid pressure force, which is communicated via fluid within the fluid conductor 302 of the conveyance system 300, to the shifting tool 204.

Figure 16:
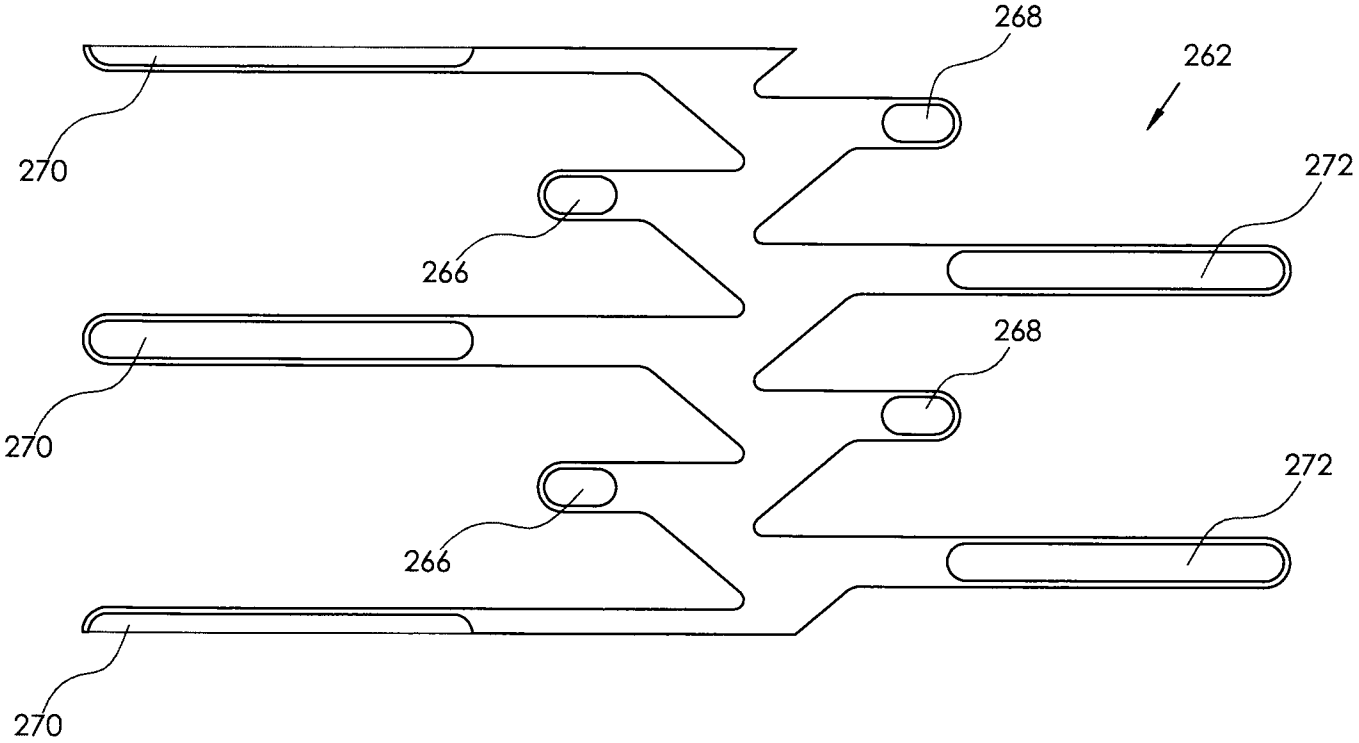
FIG. 16 is an unwrapped view of the j-slot of the bottomhole assembly of FIG. 3.

Referring to FIG. 16, the bottomhole assembly 200 includes a j-tool. The j-tool is defined by a j-slot and one or more corresponding pins 264. The j-slot 262 is formed within the shifter-actuating mandrel 260. The pins 264, extending from the locating mandrel 216, are disposed within the j-slot 262 for travel within the j-slot 262. In this respect, the locating mandrel 216 is coupled to the shifter-actuating mandrel 260 via disposition of the pins 264 within the j-slot 262. By virtue of this coupling, the shifter-actuating mandrel 260 is displaceable relative to the locating mandrel and guided by interaction between the pins 264 and the j-slot 262.

A plurality of terminuses are defined within the j-slot 262, and configured to receive the pins. Disposition of a pin 264 at any one of the terminuses defined at positions 266, 268, or 272 is such that contact engagement is effected between the pin 264 and the shifter-actuating mandrel 260, and thereby limiting relative displacement between the shifter-actuating mandrel 260 and the locator mandrel 216. This enables movement of the bottomhole assembly 200 through the wellbore 100 without effecting actuation of the shifter tool 204.

The following describes an exemplary downhole deployment of the bottomhole assembly 200 with subsequent opening of a flow controller 116 of a flow control station disposed within the wellbore 100.

Figure 3:
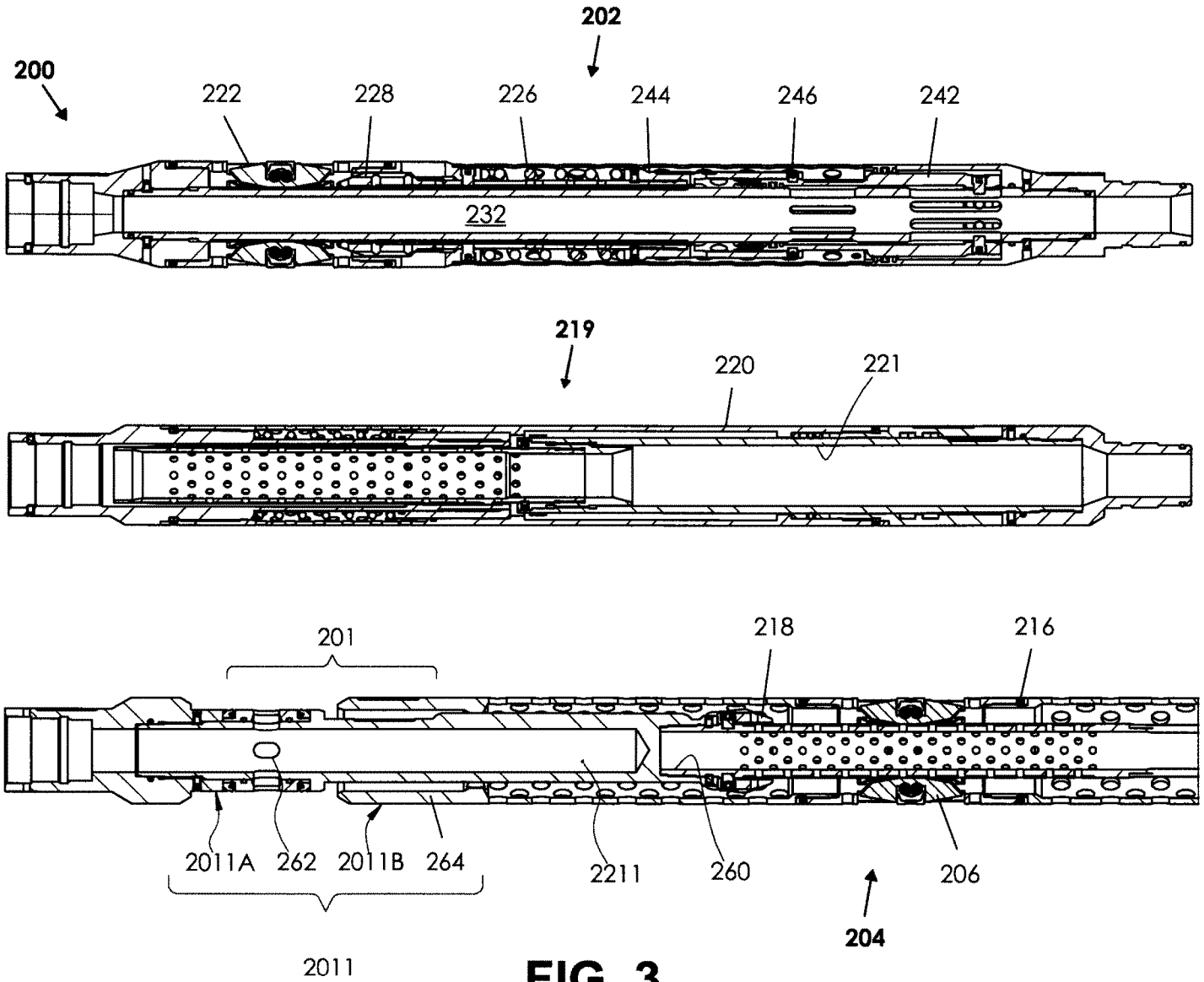
FIG. 3 is a sectional view of sections of an embodiment of a bottomhole assembly, disposed in the run-in-hole state.

Referring to FIGS. 2, 3 and 12, the bottomhole assembly 200 is run downhole through the wellbore 100, past a predetermined position (based on the length of workstring that has been run downhole). The configuration of the bottomhole assembly 200, during this stage of the process, is referred to as "run-in-hole" ("RIH") mode, and the actuator is disposed in the first force transmission state. While the assembly 200 is disposed in RIH mode, the locator mandrel 216 is urged uphole, relative to the shifter-actuating mandrel 260, by frictional forces applied by the wellbore string 102, but its uphole displacement, relative to the shifter-actuating mandrel 260, is limited such that the setting cone 218 is maintained in a spaced apart relationship relative to the shifter 206 by the j-tool. By maintaining this spaced-apart relationship, there is an absence of actuation of the shifter 206 by the setting cone 218 during the RIH mode. During the RIH mode, the pin 264 is disposed in position 266 of the j-slot 262 for maintaining this spaced-apart relationship, and there is an absence of occlusion of the flow communicator 262 by the flow controller 264 (i.e. the valve 2011 is disposed in the circulation configuration). In the RIH mode, reverse circulation can be implemented.

Referring to FIG. 4, once past the desired location, a tensile force is applied to the conveyance system 300 and the bottomhole assembly 200 reverses direction and begins travelling uphole. The configuration of the bottomhole assembly 200, during this stage of the process, is referred to as the "pull-out-of-hole" ("POOH") mode. During the uphole travel of the bottomhole assembly 200, the predetermined position is located by receiving of the locator 208A by the locate profile 108A. Successful locating of the locator 208A within the locate profile 108A is confirmed when resistance is sensed in response to upward pulling on the conveyance system 300. In the predetermined position, the shifter 206 is disposed in alignment with the flow controller 116, such that, upon its actuation, the shifter 206 becomes engaged to the flow controller 116. During the POOH mode, the pin 264 is disposed in position 268 of the j-slot 262.

Referring to FIG. 5, once the bottomhole assembly 200 is located at the predetermined position, a compressive force is applied to the conveyance system 300. In some embodiments, for example, the configuration of the bottomhole assembly 200, during this stage of the process, is referred to as the SET DOWN mode. The application of the compressive force to the conveyance system forces displacement of the shifter-actuating mandrel, relative to the shifter 206, in the downhole direction, with effect that the setting cone 218 engages the shifter 206 and forces the outwardly displacement of the shifter 206 (see FIGS. 13 and 14). As a result, the shifter 206 becomes actuated and disposed in engagement with the flow controller 116. In this respect, the shifting tool 204 becomes disposed in the shifting-ready state. In parallel, the flow communicator 262 becomes closed by the flow controller 264, such that any circulation of fluid within the wellbore 100, via the bottomhole assembly 200, is suspended (i.e. the valve 201A becomes disposed in the actuation-facilitating configuration). During the SET DOWN mode, the pin 264 is disposed in position 270 of the j-slot 262.

After the actuation of the shifter 206, fluid is supplied to the anchoring tool 222, via the conveyance system 300. Because the valve 201A is disposed in the actuation-facilitating configuration, actuation of the anchoring tool 222 is effected, with effect that the actuator tool 202 becomes disposed in the second force transmission state. With the shifting tool 204 disposed in the shifting ready state, the actuator tool 202 disposed in the second force transmission state, and the valve 201A disposed in the actuation-facilitating configuration, fluid is supplied, via the conveyance system 300, resulting in actuation of the linear actuator 219 (see FIG. 11). Concomitantly, the shifter-actuating mandrel 260 is displaced downhole relative to the shifter 206. As a result, the setting cone 218 forces the shifter 206, and the flow controller 116 to which the shifter 206 is engaged, in the downhole direction, resulting in the opening of the flow communicator 114 in response to alignment of a flow communicator 116A (for example, defined by one or more flow passages) of the flow controller 116 with the flow communicator 114 (see FIG. 15).

Next, a tensile force is applied to the conveyance system 300 and the bottomhole assembly 200 begins travelling uphole such that the pin 264 becomes disposed in position 272. Position 272 can correspond to the bottomhole assembly being pulled out of hole for locating at the next flow control station. In some embodiments, for example, the configuration of the bottomhole assembly 200, during this stage of the process, is referred to as the TENSION SET mode. Where the shifter 206 is in the form of the rocker 206A, and a second setting cone is provided for displacing the flow controller 116 in the uphole direction (for example, to reclose the flow communicator 114), position 272 can also correspond to the bottomhole assembly being pulled uphole with effect that the second setting cone actuates the shifter 206 such that the shifter 206 is actuated and forces the flow controller 116 to move in the uphole direction.

In some embodiments, for example, it is desirable to use the bottomhole assembly 200 to clean out debris that has accumulated within the wellbore as such accumulated debris can interfere with wellbore operations, such as, for example, shifting the flow controller 116 with the shifter 206.

In this respect, and referring to FIGS. 17 to 22, in some embodiments, for example, the bottomhole assembly 200 further includes a clean-out flow communicator 282, such as one or more jetting nozzles, for injecting fluid, supplied from the surface 12 via the fluid conductor 302 of the conveyance system 300, into the wellbore. In some embodiments, for example, the clean-out flow communicator 282. In some embodiments, for example, the clean-out flow communicator 282 is disposed at a distal end 200A of the bottomhole assembly 200, and is configured to be disposed at a downhole end of the bottomhole assembly 200 while the bottomhole assembly 200 is deployed within the wellbore 100. In some embodiments, for example, the bottomhole assembly includes a bull nose jetting sub 280 which defines the clean-out flow communicator 282, in the form of jetting nozzles 284. The nozzles 284 are effective for discharging fluid into the wellbore 100 for effecting removing accumulated debris via circulation up the annulus 118. The nozzles 284 are also effective for discharging fluid into the wellbore 100 for effecting removing accumulated debris via bullheading into the formation 14. The nozzles 284 are also effective for receiving fluid flow from the wellbore 100, that has been injected into the annulus 118 from the surface 12, and thereby circulating the received fluid flow to the surface 12, for removing wellbore debris that has become entrained within the fluid flow.

Figure 23:
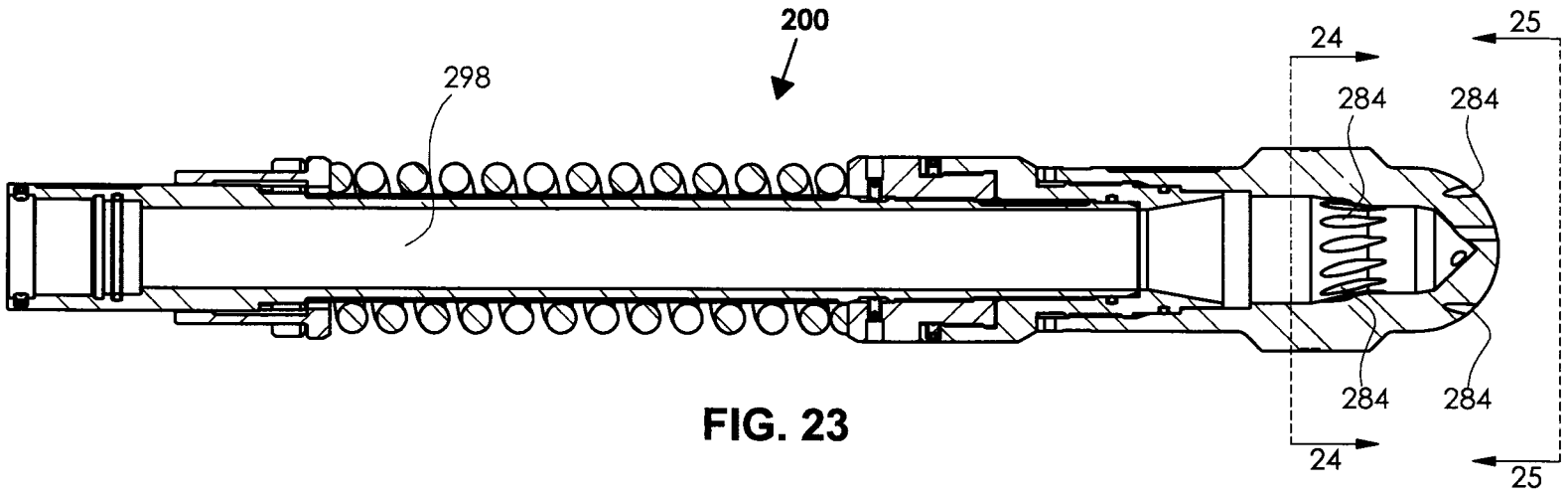
FIG. 23 is a sectional view of a downhole end of the bottomhole assembly illustrated in FIGS. 17 and 18, illustrating the bull nose jetting sub.
Figure 25:
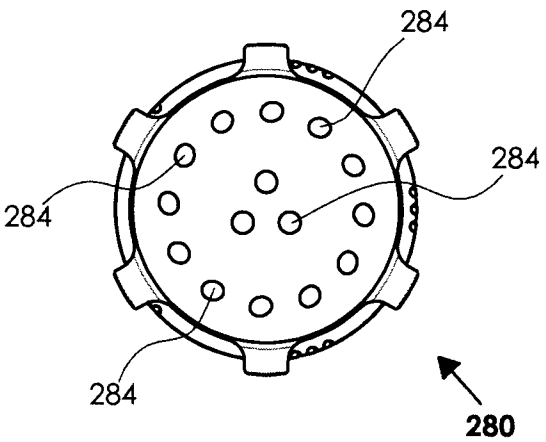
FIG. 25 is a sectional view of the downhole end of the bottomhole assembly illustrated in FIG. 23, taken along lines 25-25.
Figure 24:
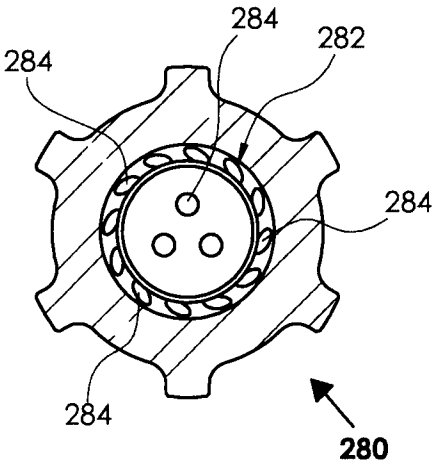
FIG. 24 is a sectional view of the downhole end of the bottomhole assembly illustrated in FIG. 23, taken along lines 24-24.

Referring to FIGS. 23 to 25, to facilitate conducting of fluid flow, between the conveyance system 300 and the clean-out flow communicator 282, fluid communication between the fluid conductor 302 and the bull nose jetting sub 280 is effectible via a fluid passage 290 that is establishable within the bottomhole assembly 200 (see FIG. 19). In this respect, the bottomhole assembly 200 includes an uphole fluid conductor 292, defining an uphole passage 296, and a downhole fluid conductor 294, defining a downhole passage 298. Once established, the fluid passage 290 includes the uphole passage 296 and the downhole passage 298. The uphole fluid conductor 292 is defined by at least the conduit 2222 (of the anchoring tool) and the piston 221. The downhole fluid conductor 294 is defined by at least the shifter-actuating mandrel 260.

Referring to FIGS. 17 and 18, to facilitate transition of the bottomhole assembly 200 such that the bottomhole assembly 200 is disposed for implementing a cleaning out operation, instead of valve 201, a valve 2013 is provided which, in addition to being configurable in a circulation configuration and an actuation-facilitating configuration, is further configurable in a flow-through configuration (see FIG. 19).

In this respect, in some embodiments, for example, while the valve 2013 is disposed in the flow-through configuration (see FIG. 19), while the valve 2013 is disposed in a flow-through configuration:

- bypass of the downhole passage 298, by fluid flow that is being conducted downhole from the surface, via the uphole passage 296, is prevented, such that the fluid flow is conductible downhole, via the downhole passage 298, to the clean-out flow communicator 282; and
- bypass of the uphole passage 296, by fluid flow that is being conducted uphole from the clean-out flow communicator 282, via the downhole passage 298, is prevented, such that the fluid flow is conductible uphole, via the uphole passage 296 to the surface 12.

In this respect, the fluid passage 290 is established while the valve 2013 is disposed in the flow-through configuration.

In some embodiments, for example, bypass of the downhole passage 298, by fluid flow that is being conducted downhole via the uphole passage 296, is prevented, such that the fluid flow is conductible downhole, via the downhole passage 298, to the clean-out flow communicator 282, only while the valve is disposed in the flow-through configuration, and bypass of the uphole passage 296, by fluid flow that is being conducted uphole, via the downhole passage 298, from the clean-out flow communicator 282, is prevented, such that the fluid flow is conductible uphole, via the uphole passage 296, only while the valve 2013 is disposed in the flow-through configuration.

Referring to FIGS. 20 and 22, while the valve 2013 is disposed in the circulation configuration, flow communication is established between the uphole passage 296 and an environment external to the bottomhole assembly 200 (e.g. the annulus 118) such that:

- bypassing, by fluid flow that is being conducted downhole via a wellbore space (e.g. the annulus 118) defined within the wellbore 100 and externally of the bottomhole assembly 200, of the uphole passage 296, is prevented; and
- bypassing, by fluid flow that is being conducted downhole via the uphole passage 296, of the wellbore space (e.g. annulus 118) defined within the wellbore and externally of the bottomhole assembly, is prevented.

In some embodiments, for example, the ratio of the rate of fluid flow during clean-out, while the valve 2013 is disposed in the flow-through configuration, to the rate of fluid flow during circulation, while the valve 2013 is disposed in the circulation configuration, is at least 2:1, such as, for example, at least 3:1. In some embodiments, the rate of fluid flow during clean-out, while the valve 2013 is disposed in the flow-through configuration, is at least 300 litres per minute, such as, for example, at least 400 litres per minute.

Referring to FIG. 21, while the valve 2013 is disposed in the actuation-facilitating configuration, flow communication, between the uphole passage 296 and the downhole passage 298 is sufficiently occluded (e.g. sealed) with effect that a wellbore tool is responsive to a fluid pressure force, that is communicated via the fluid passage 302 of the conveyance system 300 (e.g. the actuator 202 becomes responsive to the fluid pressure force for changing its state from the first force transmission state to the second force transmission state, or the shifter 206 becomes responsive to an applied fluid pressure force for becoming displaced relative to a wellbore feature). In some embodiments, for example, the flow communication, between the uphole passage 296 and the downhole passage 298 is sufficiently occluded with effect that the wellbore tool is responsive to a fluid pressure force, that is communicated via the fluid passage 302 of the conveyance system 300, for effecting a hydraulically-actuated wellbore operation, only while the valve 2013 is disposed in an actuation-facilitating condition.

In some embodiments, for example, the valve 2013 includes a first counterpart 2013A and a second counterpart 2013B.

The first counterpart 2013A is defined by a flow diverter that is interposed between the piston 221 and the shifter-actuating mandrel 260. The flow diverter 2013A includes an uphole flow communicator 2015, disposed in flow communication with the uphole passage 296, and a downhole flow communicator 2017 disposed in flow communicator with the downhole passage 298. Disposed relative to the uphole flow communicator 2015 and the downhole flow communicator 2017, for effecting sealing of flow communication, between the uphole flow communicator 2015 and the downhole flow communicator 2017, is a first sealed interface counterpart 2019.

In some embodiments, for example, the uphole flow communicator 2015 is defined by one or more passages 2015A extending downhole from the uphole passage 296. In some embodiments, for example, for each one of the one or more passages 2015A, the central longitudinal axis 2015AA of the passage 2015 is disposed at an acute angle relative to the central longitudinal axis 296A of the uphole passage 296.

In some embodiments, for example, the downhole flow communicator 2017 is defined by one or more passages 2017A extending uphole from the downhole passage 298. In some embodiments, for example, for each one of the one or more passages 2017A, the central longitudinal axis 2017AA of the passage 2017 is disposed at an acute angle relative to the central longitudinal axis 298A of the downhole passage 298.

The second counterpart 2013B includes an intermediate flow communicator 221 and a second sealed interface counterpart 2023. In some embodiments, for example, the second counterpart 2013B is defined by the locator mandrel 216.

The first counterpart 2013A and the second counterpart 2013B are co-operatively configured such that, while the valve 2013 is disposed in the flow-through configuration (see FIG. 19), the first counterpart 2013A is disposed relative to the second counterpart 2013B such that flow communication, via the intermediate flow communicator 2021, is effected between the uphole flow communicator 2015 and the downhole flow communicator 2017. In this respect, in some embodiments, for example, the intermediate flow communicator 2021 includes a recess 2021A defined within the locator mandrel 216, and, while the valve 2013 is disposed in the flow-through configuration, flow communication, between the uphole flow communicator 2015 and the downhole flow communicator 2017 is effected via the recess 2021A. By virtue of the flow communication between the uphole flow communicator 2015 and the downhole flow communicator 2017, via the intermediate flow communicator 2021, the fluid passage 290 is established such that circulation within the wellbore 100 is effectible via the fluid passage 290, and such circulation includes either one of forward circulation (i.e. fluid is conducted downhole from the surface via the fluid conductor 302 of the conveyance system 300, through at least one of the flow communicators 2015 or 2017, and the returned to the surface 12 via the annulus 118) or reverse circulation (i.e. fluid is conducted downhole from the surface via the annulus 118, through at least one of the flow communicators 2015 or 2017, and the returned to the surface 12 via the fluid conductor 302 of the conveyance system 300)

The first counterpart 2013A and the second counterpart 2013B are also co-operatively configured such that, while the valve 2013 is disposed in the actuation-facilitating configuration (see FIG. 21), the first sealed interface counterpart 2019 is disposed relative to the second sealed interface counterpart 2023 such that a sealed interface is established, with effect that sealing of flow communication between the uphole flow communicator 2015 and the downhole flow communicator 2017, and, therefore, between the uphole passage 296 and the downhole passage 298, is effected. In some embodiments, for example, the first sealed interface counterpart 2019 includes a sealing member 2019A and the second sealed interface counterpart 2023 includes a corresponding sealing surface 2023A for becoming disposed in sealing engagement with the sealing member 2019A of the first sealed interface counterpart 2019.

The first counterpart 2013A and the second counterpart 2013B are also co-operatively configured such that, while the valve 2013 is disposed in the circulation configuration (see FIGS. 20 and 22), there is an absence of occlusion of at least one of the uphole flow communicator 2015 and the downhole flow communicator 2017, of the flow diverter 2013 (and, in some embodiments, both), such that circulation is effectible via at least one of the uphole flow communicator 2015 and the downhole flow communicator 217, and such circulation includes either one of forward circulation (i.e. fluid is conducted downhole from the surface via the fluid conductor 302 of the conveyance system 300, through at least one of the flow communicators 2015 or 2017, and the returned to the surface 12 via the annulus 118) or reverse circulation (i.e. fluid is conducted downhole from the surface via the annulus 118, through at least one of the flow communicators 2015 or 2017, and then returned to the surface 12 via the fluid conductor 302 of the conveyance system 300).

While the bottomhole assembly 200 is being run downhole through the wellbore 100 in the RIH mode, the valve 2013 is disposed in the flow-through configuration (see FIG. 19). In reversing direction such that the bottomhole assembly 200 becomes disposed in the POOH mode, the valve 2013 transitions to the circulation configuration (see FIG. 20). During the SET DOWN mode, the valve 2013 is disposed in the actuation-facilitating configuration (see FIG. 21). During the TENSION SET mode, the valve 2013 is disposed in the circulation configuration (see FIG. 22). Transitioning of the embodiment of the bottomhole assembly 200 illustrated in FIGS. 17 to 22), between these states, is mediated by the j-tool in a similar manner as described above with respect to the transitioning of the embodiment of the bottomhole assembly 200 illustrated in FIGS. 3 to 15).

Figure 26:
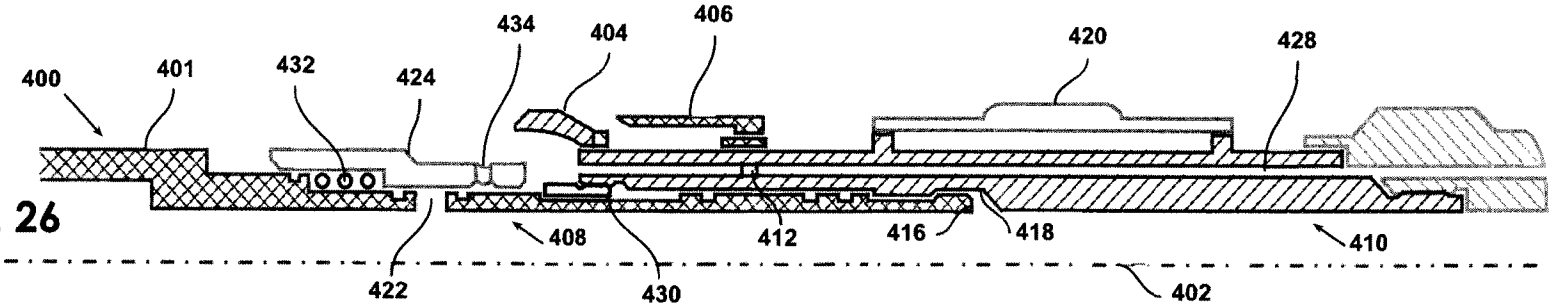
FIG. 26 is a schematic illustration of a fluid pressure responsive sub of a bottomhole assembly, illustrated in a configuration where the resilient pressure differential-establishing member is disposed in an extended state.
Figure 27:
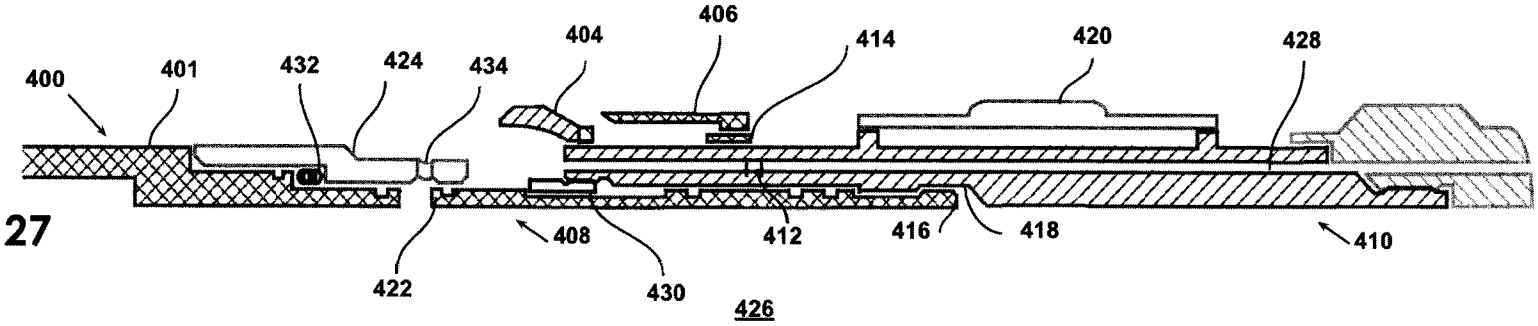
FIG. 27 is a schematic illustration of a fluid pressure responsive sub of a bottomhole assembly, illustrated in a configuration where the resilient pressure differential-establishing member is disposed in an extended state, and the pressure relief flow communicator is disposed in an open condition for effecting pressure relief.
Figure 28:
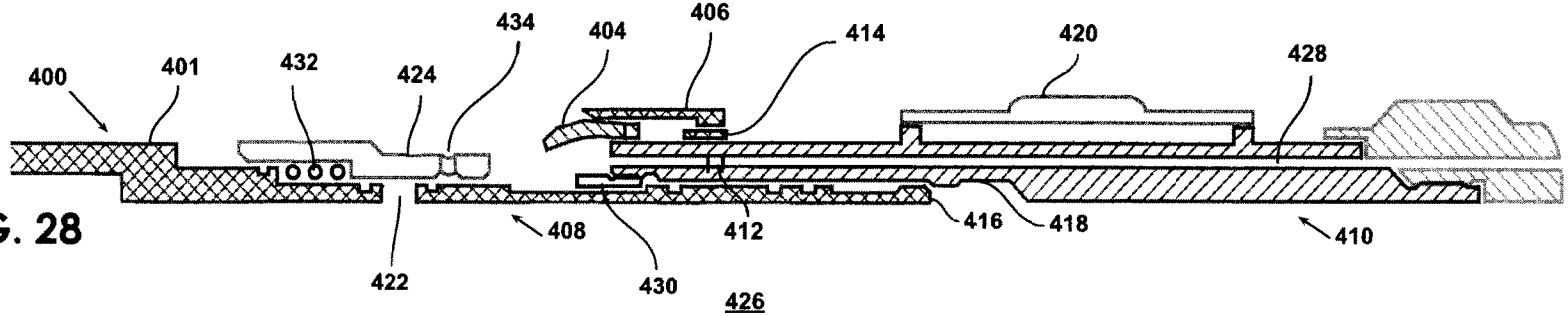
FIG. 28 is a schematic illustration of a fluid pressure responsive sub of a bottomhole assembly, illustrated in a configuration where the resilient pressure differential-establishing member is disposed in a retracted state.

In some embodiments, for example, the bottomhole assembly 200 is further configured for deployment within the wellbore 100 via application of fluid pressure within the wellbore 100. In this respect, and referring to FIGS. 26 to 28, a fluid pressure responsive sub 400 can be incorporated within the bottomhole assembly 200.

The fluid pressure responsive sub 400 includes a body 401 including a central longitudinal axis 402 and a resilient pressure differential-establishing member 404.

In some embodiments, for example, the resilient pressure differential-establishing member 404 includes an elastomeric material. In some embodiments, for example, the elastomeric material is reinforced by metallic material, such as, for example, metal wire.

The resilient pressure differential-establishing member 404 is secured to the body 401. The resilient pressure differential-establishing member 404 is configurable in a retracted state and an extended state (see FIG. 26). Relative to the retracted state, in the extended state, the resilient pressure differential-establishing member 404 is disposed further outwardly relative to the central longitudinal axis 402 of the body 401.

The resilient pressure differential-establishing member 404 is transitionable from the retracted state to the extended state in response to receiving application of a force from pressurized fluid disposed within the wellbore space (e.g. annulus 118). In response to receiving application of a force from pressurized fluid disposed within the wellbore space (e.g. annulus 118), the resilient pressure differential-establishing member 404 is forced to pivot in an outwardly direction. In this respect, while: (i) the bottomhole assembly 200 is disposed within a wellbore, (ii) the resilient pressure differential-establishing member 404 is disposed in the extended state, and (iii) pressurized fluid is disposed within the wellbore space (e.g. annulus 118): a pressure differential is established across the resilient pressure differential-establishing member 404, with effect that displacement of the bottomhole assembly 200 is urged in a downhole direction within the wellbore. This effects downhole deployment of the bottomhole assembly 200.

In those embodiments where the wellbore is cased, in some embodiments, for example, in the extended state, the resilient pressure differential-establishing member 404 is engaged to the casing. In some of these embodiments, for example, the engagement is a sealing engagement.

In some embodiments, for example, the body 401 includes an upper mandrel 408 and a lower mandrel 410. The upper mandrel 408 is slidably mounted to the lower mandrel 410 via a split collar 430, which functions, amongst other things, functions as a stop versus uphole relative uphole movement of the upper mandrel 408.

In some embodiments, for example, the securing of the resilient pressure differential-establishing member 404 to the body 401 is defined by securing of the resilient pressure differential-establishing member 404 to the lower mandrel 410.

In some embodiments, for example, the sub 400 further includes a retractor 406. The upper mandrel 408 is coupled to the retractor 406 via a pin 412 that extends through a slot 414 defined within the lower mandrel 410. The upper mandrel 408 includes a collet 416 that is releasably retainable within a recess 418 defined within the lower mandrel 410. While: (i) the bottomhole assembly 200 is disposed within a wellbore, (ii) the resilient pressure differential-establishing member 404 is disposed in the extended state, and (iii) pressurized fluid is disposed within the wellbore space (e.g. annulus 118): a pressure differential is established across the resilient pressure differential-establishing member 404, with effect that the bottomhole assembly 200 is moved in a downhole direction within the wellbore. While: (i) the bottomhole assembly 200 is disposed within a wellbore, and (ii) the resilient pressure differential-establishing member 404 is disposed in the extended state, in response to urging of movement of the upper mandrel 408 in an uphole direction within the wellbore: the collet 416 is deflected with effect that the releasable retention is defeated, with effect that the upper mandrel 408 is released from retention relative to the lower mandrel 410 and the upper mandrel 408 is moved in the uphole direction within the wellbore, and in response to the movement of the upper mandrel 408 in the uphole direction, the retractor 406 translates with the upper mandrel 408, with effect that the retractor 406 becomes disposed relative to the resilient pressure differential-establishing member 404 such that retraction of the resilient pressure differential-establishing member 404, from the extended state, is urged by the retractor 406.

In some embodiments, for example, the sub 400 further includes a drag block 420. The drag block 420 is mounted to an outermost surface of the lower mandrel 410 for engaging a wellbore-defining surface, with effect that, in response to the urging of movement of the upper mandrel 408 in an uphole direction, movement of the lower mandrel 410 in the uphole direction, is resisted. This facilitates deflection of the collet 416 and, therefore, releasing the upper mandrel 408 from retention relative to the lower mandrel 410, and thereby enabling uphole displacement of the upper mandrel 408 relative to the lower mandrel 410.

In some embodiments, for example, the sub 400 further includes a pressure relief assembly including a pressure relief flow communicator 422 (e.g. one or more fluid passages) extending through the upper mandrel 408 for conducting fluid flow, and a flow controller 424. Relatedly, a relief passage 426 is defined within the sub 400. The pressure relief flow communicator 422 is configurable in a closed configuration (see FIG. 26) and an open configuration (see FIG. 27). In the closed configuration, the pressure relief flow communicator 422 is closed by the flow controller 424. The flow controller 424 is biased to a disposition relative to the pressure relief flow communicator 422 such that the closure of the pressure relief flow communicator 422 is effected. In some embodiments, for example, the biasing is effected by a resilient member, such as, for example, a spring 432. In the open configuration, the pressure relief flow communicator 422 is open. In some embodiments, for example, a flow controller 424 flow communicator 434 extend through the flow controller 424, and the open configuration is established upon alignment between the flow controller 424 flow communicator 434 and the pressure relief flow communicator 422. Transitioning of the pressure relief flow communicator 422 from the closed configuration to the open configuration is effectible in response to urging of displacement of the flow controller 424, relative to the pressure relief flow communicator 422, by pressurized fluid disposed at a predetermined minimum pressure within the wellbore space (e.g. annulus 118). The resilient pressure differential-establishing member 404, the pressure relief flow communicator 422, and flow controller 424 are co-operatively configured such that, in response to the transitioning of the pressure relief flow communicator 422 from the closed configuration to the open configuration: flow communication is effected between the relief passage 426 and the wellbore space (e.g. annulus 118); the pressure of the pressurized fluid within the wellbore space (e.g. annulus 118) decreases; and the pressure decrease is insufficient to effect transitioning of the resilient pressure differential-establishing member 404 from the extended state to the retracted state, such that the resilient pressure differential-establishing member 404 remains disposed in the extended state. In some embodiments, for example, the cross-sectional flow area of the pressure relief flow communicator 422 is between 0.25 square inches and 0.5 square inches.

In some embodiments, for example, the pressure relief assembly mitigates overpressuring of the resilient pressure differential-establishing member 404. In some embodiments, for example, the pressure relief assembly mitigates the onset of conditions which could lead to run away relative to the conveyance system (e.g. coiled tubing).

In some embodiments, for example, the sub 400 further includes a drag-inducing flow communicator 428 extending through the lower mandrel 410 for conducting fluid flow. While: (i) the bottomhole assembly 200 is disposed within a wellbore, (ii) the resilient pressure differential-establishing member 404 is disposed in the extended state, and (iii) pressurized fluid is disposed within the wellbore space (e.g. annulus 118): the pressurized fluid is conducted through the drag-inducing flow communicator 428 and exerts a drag force on the lower mandrel 410, with effect that displacement of the bottomhole assembly 200 is further urged in a downhole direction within the wellbore. In some embodiments, for example, the minimum cross-sectional flow area of at least 0.05 square inches.

In those embodiments where the sub 400 includes a drag-inducing flow communicator 428 extending through the lower mandrel 410 for conducting fluid flow, and also includes the pressure relief assembly described above, the ratio of the cross-sectional flow area of the pressure relief flow communicator 422 to the cross-sectional flow area of the drag-inducing flow communicator 428 is at least 2.5:1, such as, for example, at least 3:1.

In some embodiments, for example, the sub 400 is integrated within an embodiment similar to the embodiment of the bottomhole assembly 200 illustrated in FIGS. 17 to 25. In such embodiments, for example, the sub 400 is integrated downhole of the locator mandrel 216 and uphole of the bull nose jetting sub 280. In these embodiments, the sub 400 includes the drag-inducing flow communicator 428 for facilitating fluid, that is being pump down the wellbore space (e.g. annulus 118) for effecting downhole deployment of the bottomhole assembly 200, to flow downhole of the bottomhole assembly 200 (i.e. downhole of the bull nose jetting sub 280) so as to effect bullheading or reverse circulation for purposes of wellbore clean-out, with effect that solid debris are cleared from the path along which the bottomhole assembly 200 is being moved.

In some embodiments, for example, the resilient pressure differential-establishing member 404, the drag block 420, and the collet 416 are co-operatively configured such that there is some confidence that the collet 416 is deflected in response to urging of movement of the upper mandrel 408 in an uphole direction within the wellbore 100 (e.g. POOH mode). In this respect, in those embodiments where the wellbore is cased, the force applied by the casing to the drag block 420, while the upper mandrel 408 is being pulled up hole, is greater than the force required to deflect the collet 416. As well, in those embodiments where, in the extended configuration, the resilient pressure differential-establishing member 404 is disposed in engagement with the casing, the force applied by the casing to the pressure differential-establishing member 404 is less than the force required to deflect the collet 416.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A bottomhole assembly, configured for coupling to a conveyance system for downhole deployment within a wellbore, wherein the conveyance system defines a fluid passage, comprising:

an actuator tool including an anchoring tool and a linear actuator;

wherein:

the coupling is such that the actuator tool is disposed in fluid communication with the fluid passage;

the actuator tool is configurable in first and second force transmission states;

in the first force transmission state, there is an absence of actuation of the anchoring tool and an absence of retention of the anchoring tool relative to the wellbore;

in the second force transmission state, the anchoring tool is disposed in an actuated state for retention relative to the wellbore; and while the coupling of the bottomhole assembly and the conveyance system is established within the wellbore:

while the actuator tool is disposed in the first force transmission state, the actuator tool is disposed for receiving transmission of a compressive force being applied to the conveyance system from the surface, and transmitting the compressive force for effecting a first wellbore operation; and while the actuator tool is disposed in the second transmission state, and the anchoring tool is being retained relative to the wellbore, the linear actuator is actuatable, in response to receiving a fluid pressure force that is communicated via the fluid passage of the conveyance system, for effecting a second wellbore operation.

2. The bottomhole assembly as claimed in claim 1; further comprising:

a shifting tool that is responsive to each one of, independently, the compressive force being transmitted by the actuator tool, and the actuation of the linear actuator.

3. A bottomhole assembly, configured for coupling to a conveyance system for downhole deployment within a wellbore, wherein the conveyance system defines a fluid passage, comprising:

a valve; and a wellbore tool;

wherein:

the valve is configurable in a circulation configuration and an actuation-facilitating configuration;

while the valve is disposed in a circulation configuration, flow communication is established between the fluid passage and an environment external to the bottomhole assembly; and while the valve is disposed in an actuation-facilitating configuration, flow communication between the fluid passage and the environment external to the bottomhole assembly is sufficiently occluded, with effect that the wellbore tool is responsive to a fluid pressure force, the fluid pressure force being communicated via the fluid passage for effecting a hydraulically-actuated wellbore operation, the valve being configurable from the circulation configuration to the actuation-facilitating configuration, and further configurable from the actuation-facilitating configuration to the circulation configuration.

4. The bottomhole assembly as claimed in claim 3; wherein:

flow communication, between the fluid passage and the environment external to the bottomhole assembly is sufficiently occluded for effecting a hydraulically-actuated wellbore operation, only while the valve is disposed in the actuation-facilitating condition.

5. The bottomhole assembly as claimed in claim 3; further comprising:

a j-tool;

wherein:

the valve includes first and second counterparts; and the valve is configurable in the circulation and actuation-facilitating configurations in response to relative movement between the first and second counterparts; and the relative movement is mediated by the j-tool.

6. The bottomhole assembly as claimed in claim 5; wherein:

the circulation and actuation-facilitating configurations are determined by terminuses within a slot of the j-tool.

7. The bottomhole assembly as claimed in claim 3; wherein:

the bottomhole assembly is disposed for receiving transmission of a compressive force being applied to the conveyance system from the surface, and transmitting the compressive force for effecting the another wellbore operation.

8. The bottomhole assembly as claimed in claim 3; wherein:

the sufficient occluding of flow communication is defined by a closing of the flow communication.

9. The bottomhole assembly as claimed in claim 3; further comprising:

a flow communicator for circulating, within the wellbore, fluid that is conducted from the surface via the fluid passage; and a flow controller for occluding the flow communicator; wherein:

the flow communicator, the flow controller, and the wellbore tool are co-operatively configured such that, while the flow communicator is occluded by the flow controller, the valve is disposed in the actuation-facilitating configuration and the wellbore tool is responsive to the fluid pressure force, that is communicated via the fluid passage of the conveyance system, for effecting the hydraulically-actuated wellbore operation.

10. A bottomhole assembly, configured for coupling to a conveyance system for downhole deployment within a wellbore, wherein the conveyance system defines a fluid passage, comprising:

an uphole passage for disposition in flow communication with the fluid passage of the conveyance system while the bottomhole assembly is coupled to the conveyance system;

a downhole passage;

a valve for controlling flow communication between the uphole passage and the downhole passage; and a wellbore tool; and a clean-out flow communicator, disposed in flow communication with the downhole passage for discharging fluid, that is being conducted via the downhole passage externally of the bottomhole assembly, and for receiving fluid flow externally of the bottomhole assembly;

wherein:

the valve is configurable in at least a flow-through configuration and an actuation-facilitating configuration;

while the valve is disposed in the flow-through configuration:

bypass of the downhole passage, by fluid flow that is being conducted downhole via the uphole passage, is prevented, such that the fluid flow is conductible downhole, via the downhole passage, to the clean-out flow communicator; and bypass of the uphole passage, by fluid flow that is being conducted uphole via the downhole passage from the clean-out flow communicator, is prevented, such that the fluid flow is conductible uphole, via the uphole passage;

and while the valve is disposed in the actuation-facilitating condition, flow communication between the uphole passage and the downhole passage is sufficiently occluded with effect that the wellbore tool is responsive to a fluid pressure force, that is communicated via the fluid passage of the conveyance system, for effecting a hydraulically-actuated wellbore operation, the valve being configurable from the flow-through configuration to the actuation-facilitating configuration, and further configurable from the actuation-facilitating configuration to the flow-through configuration.

11. The bottomhole assembly as claimed in claim 10; wherein:

bypass of the downhole passage by fluid flow that is being conducted downhole via the uphole passage is prevented only while the valve is disposed in the flow-through configuration; and bypass of the uphole passage, by fluid flow that is being conducted uphole via the downhole passage is prevented only while the valve is disposed in the flow-through configuration.

12. The bottomhole assembly as claimed in claim 10; wherein:

the flow communication, between the uphole passage and the downhole passage is sufficiently occluded with effect that the wellbore tool is responsive to a fluid pressure force, that is communicated via the fluid passage of the conveyance system, for effecting a hydraulically-actuated wellbore operation, only while the valve is disposed in an actuation-facilitating condition.

13. The bottomhole assembly as claimed in claim 10; further comprising:

a j-tool;

wherein:

the valve includes first and second counterparts;

the valve is configurable in the flow through and actuation-facilitating configurations in response to relative movement between the first and second counterparts; and the relative movement is mediated by the j-tool.

14. The bottomhole assembly as claimed in claim 13; wherein:

the flow-through and actuation-facilitating configurations are determined by terminuses within a slot of the j-tool.

15. The bottomhole assembly as claimed in claim 10; wherein:

the bottomhole assembly is disposed for receiving transmission of a compressive force being applied to the conveyance system from the surface, and transmitting the compressive force for effecting another wellbore operation.

16. The bottomhole assembly as claimed in claim 10; wherein:

the sufficient occluding of flow communication, between the uphole passage and the downhole passage, with effect that the wellbore tool is responsive to a force applied by a pressurized fluid, that is communicated via the fluid passage of the conveyance system, for effecting a hydraulically-actuated wellbore operation, is defined by a closing of the flow communication.

17. The bottomhole assembly as claimed in claim 10; wherein:

the valve is further configurable in a circulation configuration; and while the valve is disposed in the circulation configuration, flow communication is established between the uphole passage and an environment external to the bottomhole assembly such that:

bypassing of the uphole passage, by fluid flow that is being conducted downhole via a wellbore space defined within the wellbore and externally of the bottomhole assembly, is prevented; and bypassing of the wellbore space defined within the wellbore and externally of the bottomhole assembly, by fluid flow that is being conducted downhole via the uphole passage, is prevented.

* * * * *